US010061254B2

(12) United States Patent
Umehara et al.

(10) Patent No.: US 10,061,254 B2
(45) Date of Patent: Aug. 28, 2018

(54) IMAGE FORMING SYSTEM WITH INFORMATION ON CONVEYING SPEED TRANSFERRED BETWEEN CONTROL UNITS

(71) Applicant: CANON KABUSHIKI KAISHA, Tokyo (JP)

(72) Inventors: Ryuichi Umehara, Yokohama (JP); Toshiya Kaino, Suntou-gun (JP); Atsushi Kawarago, Suntou-gun (JP); Jun Asami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/291,170

(22) Filed: Oct. 12, 2016

(65) Prior Publication Data

US 2017/0102654 A1 Apr. 13, 2017

(30) Foreign Application Priority Data

Oct. 13, 2015 (JP) ..... 2015-202125
Aug. 12, 2016 (JP) ..... 2016-158956

(51) Int. Cl.
*G03G 15/16* (2006.01)
*G03G 15/00* (2006.01)

(52) U.S. Cl.
CPC ..... *G03G 15/6529* (2013.01); *G03G 2215/00945* (2013.01); *G03G 2215/00949* (2013.01); *G03G 2215/2035* (2013.01); *G03G 2215/2045* (2013.01)

(58) Field of Classification Search
CPC ..... G03G 15/2085
USPC ..... 399/68
See application file for complete search history.

(56) References Cited

U.S. PATENT DOCUMENTS 5,819,149 A * 10/1998 Watanabe ..... G03G 15/657 399/330
8,068,778 B2 11/2011 Kaino et al.
8,430,392 B2 4/2013 Nada et al.
8,646,776 B2 2/2014 Agata et al.
(Continued)

FOREIGN PATENT DOCUMENTS

JP 2001-106380 A 4/2001
JP 2002-311659 A 10/2002
(Continued)

*Primary Examiner* — Quana M Grainger
(74) *Attorney, Agent, or Firm* — Fitzpatrick, Cella, Harper & Scinto

(57) ABSTRACT

An image forming system includes an image forming apparatus and a discharging device. The image forming apparatus includes a first rotatable member, a second rotatable member positioned downstream of the first rotatable member, a first driving portion for driving the first and second rotatable members, and a first controller for controlling the first driving portion. The discharging device includes a third rotatable member, a second driving portion for driving the third rotatable member, and a second controller for controlling the second driving portion. The first controller controls a driving speed of the second rotatable member depending on a driving speed of the first rotatable member and feeds the driving speed of the first rotatable member to the second controller. The second controller controls a driving speed of the third rotatable member depending on the driving speed fed from the first controller.

20 Claims, 10 Drawing Sheets

(56) References Cited

U.S. PATENT DOCUMENTS

| | | | | |
|---|---|---|---|---|
| 2004/0037600 | A1* | 2/2004 | Eda | G03G 15/657 399/388 |
| 2006/0051116 | A1 | 3/2006 | Koshida | |
| 2007/0009271 | A1* | 1/2007 | Tanonaka | G03G 15/657 399/45 |

FOREIGN PATENT DOCUMENTS

| | | | |
|---|---|---|---|
| JP | 2006-124125 | A | 5/2006 |
| JP | 2013-105125 | A | 5/2013 |
| JP | 2013-130741 | A | 7/2013 |

* cited by examiner (a)

| | PRESSING ROLLER | DISCHARGING ROLLER | FEEDING ROLLER |
|---|---|---|---|
| FEEDING FORCE | F1 | F2 | F3 |
| | STRONG | WEAK | MEDIUM |

(b)

(a)

(b)

IMAGE FORMING SYSTEM WITH INFORMATION ON CONVEYING SPEED TRANSFERRED BETWEEN CONTROL UNITS

FIELD OF THE INVENTION AND RELATED ART

The present invention relates to an image forming system including an image forming apparatus and a recording material discharging device and particularly relates to feeding stability of a recording material.

As a heating type of a fixing device mounted in the image forming apparatus, there is a film heating type using a fixing film, and in a side opposing the fixing film, a pressing roller which is an elastic member and which is a thermally expandable rotatable member is used. In the case where the film heating type is employed, the pressing roller thermally expands by heating from the fixing film and fluctuates in outer diameter. In the case where rotatable members provided upstream and downstream of the pressing roller of the fixing device in a feeding path only slightly expand thermally, a feeding speed of a recording material by the pressing roller becomes high, and therefore a peripheral speed relationship between each rotatable member and the pressing roller fluctuates, so that a feeding state of the recording material becomes unstable. As a result, there is a liability that paper jam of the recording material and image defect are generated.

Therefore, in the case where a transfer portion upstream of the pressing roller in the feeding path is driven by a driving source, a degree of flection (bending) of the recording material between the transfer portion and the fixing device is detected using a loop sensor. Then, on the basis of a detection result, by changing a driving speed of the driving source for the pressing roller, the feeding speed of the recording material by the pressing roller is made substantially constant irrespective of an outer diameter fluctuation of the pressing roller (hereinafter this control is referred to as loop control). As a result, the feeding state of the recording material is stabilized while avoiding pulling of the recording material between the rotatable members and excessive flection of the recording material. Such a technique is disclosed in Japanese Laid-Open Patent Application (JP-A) 2001-106380, for example.

Further, also as regards a fixing discharging roller provided downstream of the pressing roller in the feeding path, similarly as in the above-described loop control, in the case where the pressing roller and the fixing discharging roller are driven by different driving sources, a loop sensor is provided between the pressing roller and the fixing discharging roller. Then, on the basis of a detection result of the loop sensor, loop control is effected, so that the recording material feeding state is stabilized. Such a constitution is disclosed in JP-A 2013-105125.

However, in the above-described conventional examples, the recording material feeding speed between feeding rollers in the image forming apparatus is controlled. For example, in the case where a discharging device of the recording material is provided downstream of the image forming apparatus in the recording material feeding path, it is difficult to control a feeding speed relationship between a mostdownstream roller in the feeding path in the image forming apparatus side and a mostupstream roller in the feeding path in the discharging device side. For this reason, by a change in recording material feeding speed of the mostdownstream roller in the image forming apparatus side, pushing and pulling of the recording material generate between the mostdownstream roller in the image forming apparatus side and the mostupstream roller in the discharging device, with the result that there is a problem such that paper jam and image defect due to friction of the recording material with the feeding path generate.

SUMMARY OF THE INVENTION

The present invention has been accomplished in view of the above-described circumstances. A principal object of the present invention is to provide an image forming system capable of stabilizing a feeding state of a recording material between an image forming apparatus and a discharging device.

According to an aspect of the present invention, there is provided an image forming system comprising: an image forming apparatus for forming an image on a recording material; and a discharging device for discharging the recording material on which the image is formed, wherein the image forming apparatus includes, a first rotatable member for feeding the recording material, a second rotatable member positioned downstream of the first rotatable member along a feeding path with respect to a recording material feeding direction, first driving means for driving the first rotatable member and the second rotatable member, and first control means for controlling the first driving means, wherein the discharging device includes, a third rotatable member for feeding the recording material fed from the image forming apparatus, second driving means for driving the third rotatable member, and second control means for controlling the second driving means, wherein the first control means controls a driving speed of the second rotatable member depending on a driving speed of the first rotatable member and feeds the driving speed of the first rotatable member to the second control means, and wherein the second control means controls a driving speed of the third rotatable member depending on the driving speed fed from the first control means.

Further features of the present invention will become apparent from the following description of exemplary embodiments with reference to the attached drawings.

DESCRIPTION OF THE EMBODIMENTS

Figure 1:
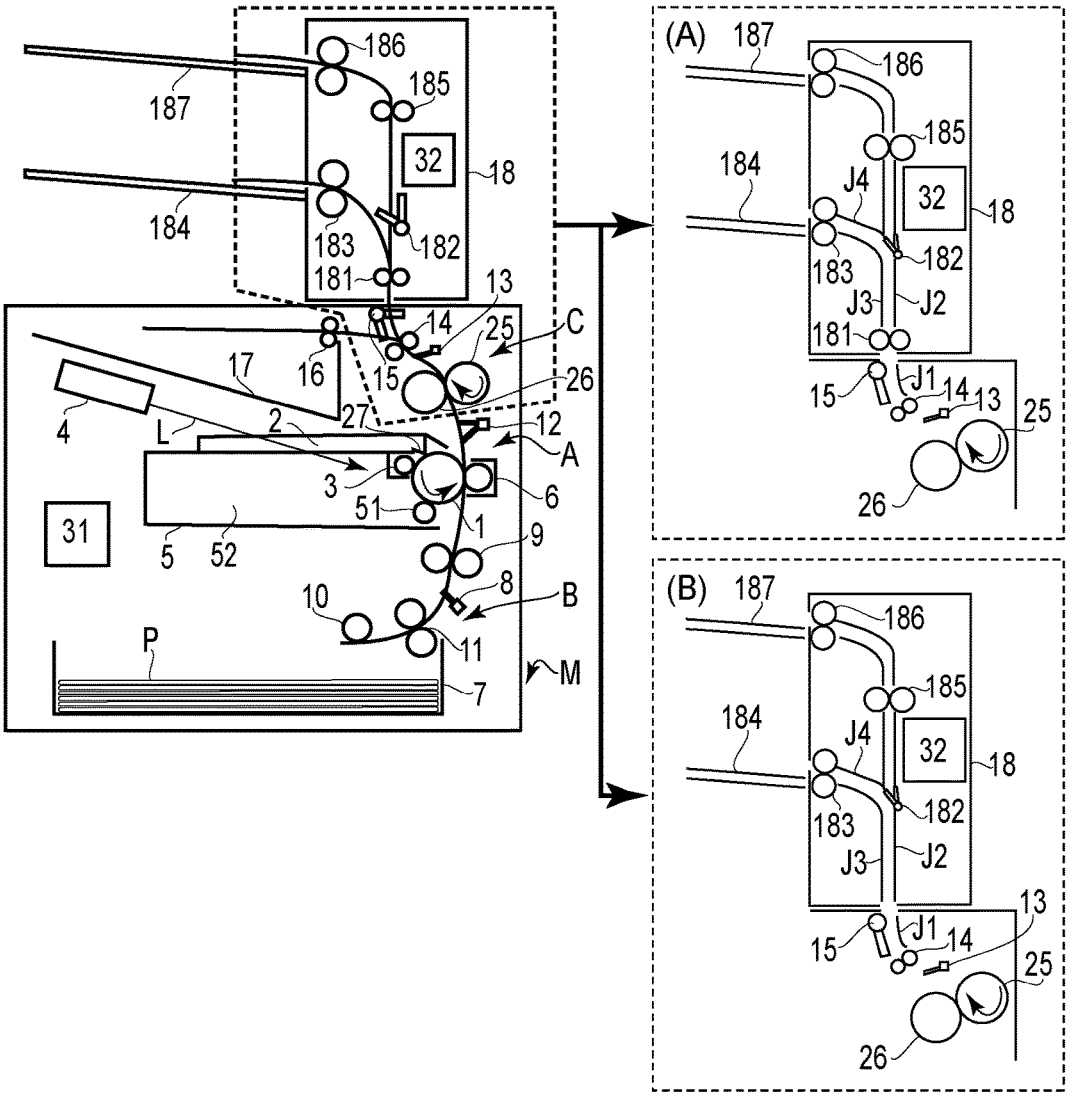
FIG. 1 is a sectional view showing a structure of an image forming apparatus and a discharging device.

Embodiments of the present invention will be described specifically with reference to the drawings. First, in advance of description of Embodiments described later, problems of recording material feeding in the case of an image forming system in which a recording material discharging device or the like is provided downstream of an image forming apparatus in a recording material feeding path will be described in detail.

During an image forming operation, a pressing roller of a fixing device thermally expands by heat conducted from a fixing film and its outer diameter fluctuates. On the other hand, a fixing discharging roller provided in a mostdownstream side of the image forming apparatus in the recording material fixing device does not contact the fixing film which is a heat source, and therefore a degree of the outer diameter fluctuation due to thermal expansion is small compared with the pressing roller. Here, the case where the pressing roller and the fixing discharging roller are driven by the same driving source 41 (FIG. 5) although thermal expansion amounts of the pressing roller and the fixing discharging roller are different from each other will be studied. In the case where during the image forming operation, a driving speed of the pressing roller is optimized correspondingly to the thermal expansion amount of, e.g., the pressing roller so that the region feeding speed is unchanged, the feeding speed of the recording material by the pressing roller is stabilized. However, as regards the fixing discharging roller small in outer diameter fluctuation due to the thermal expansion, the recording material feeding speed is not stabilized, but becomes excessively higher or lower than the recording material feeding speed of the pressing roller in some cases. As a result, in the case where the mostupstream feeding roller in the discharging device side is driven at a certain speed, a recording material feeding state becomes unstable between the fixing discharging roller which fluctuates in feeding speed and the mostupstream feeding roller which is provided downstream of the fixing discharging roller and which is disposed in the discharging device side. As a result, jam of the recording material, and image friction and damage of the recording material due to contact of the recording material with a wall of the feeding roller generate in some cases.

For example, in such a situation that the pressing roller is cool, the driving source 41 is rotated at high speed in order to avoid accumulation of flection (loop) of the recording material between the transfer portion and the fixing device. Then, the feeding speed of the fixing discharging roller driven by the same driving source 41 is higher than the feeding speed of the mostupstream feeding roller in the discharging device side in some cases, so that the flection of the recording material excessively accumulates between the fixing discharging roller and the mostupstream feeding roller in the discharging device side in some instances. As a result, in the case of low-rigidity paper such as thin paper, when waving, paper jam due to an insufficient feeding force and deposition of a contaminant on the feeding path are caused, there is a liability that image defect due to the deposition of the contamination or the like on the recording material and the damage of the recording material due to friction are generated. On the other hand, in the case of a high-rigidity recording material such as thick paper, the flection of the recording material accumulates between the fixing discharging roller and the mostupstream feeding roller in the discharging device side and slides with the feeding path, so that a back tension to the mostupstream feeding roller in the discharging device side increases. As a result, there is a liability that the paper jam, the image defect due to the slide (friction) of the recording material with the feeding path, and the damage of the recording material generate.

Further, in a situation that the pressing roller thermally expands by the heat conducted from the fixing film, the driving source 41 is rotated at high speed in order to avoid pulling of the recording material between the transfer portion and the fixing device. Then, the feeding speed of the fixing discharging roller driven by the same driving source 41 is lower than the feeding speed of the mostupstream feeding roller in the discharging device side in some cases, so that the recording material is pulled between the fixing discharging roller and the mostupstream feeding roller in the discharging device side and is excessively extended linearly in some instances. As a result, the recording material slides with a curved feeding path, and an excessive tension is exerted on the fixing discharging roller and the discharging device-side feeding roller, so that there is a liability that the image defect and the recording material damage generate. Further, by the slide of the recording material with the feeding path, the back tension is applied to the mostupstream feeding roller in the discharging device side, so that there is also a liability that the paper jam occurs.

In order to solve these problems, it would be considered that the following countermeasures are taken. For example, the feeding path is made long, and thus a time when the recording material is carried and fed between the fixing discharging roller and the discharging device-side feeding roller is decreased, so that a time when the fixing discharging roller pushes the recording material is shortened. As a result, it is possible to decrease a degree of accumulation of the loop (flection) of the recording material between the fixing discharging roller and the discharging device-side feeding roller. Further, it would be considered that a countermeasure having a constitution in which the feeding path is broadened (increased in width) with respect to a direction perpendicular to a recording material feeding direction and thus the recording material does not readily slide with the feeding path even in the case where the loop accumulates and in the case where the recording material is pulled between the rollers is taken. However, from the market, downsizing of the image forming apparatus and the discharging device is required from the viewpoint of ease of arrangement of the apparatus and the device, so that in the above-described two countermeasures, the apparatus (device) size becomes large, and therefore goes against needs of the market. Further, it would be also considered that a countermeasure that the pulling and the loop of the recording material between the rollers are eliminated by providing a loop detecting portion, e.g., between the fixing discharging roller and the discharging device-side feeding roller is taken. In this case, in order to provide the loop detecting portion, there is a need to use a member such as a sensor flag or a photo-interrupter, so that a cost thereof increases.

(Embodiment 1)

[Image Forming Apparatus]

An image forming apparatus in this embodiment will be described. FIG. 1 shows an example of an electrophotographic image forming apparatus and is a sectional view showing a general structure of a monochromatic printer in which image formation is effected using a black toner. In a main assembly M of the image forming apparatus shown in FIG. 1, a recording material discharging device 18 including discharging trays 184 and 187 on which recording materials on which images are formed are to be discharged. Portions (A) and (B) shown in a right-hand side of FIG. 1 are enlarged views each showing a structure of a portion enclosed by a broken line in a left-hand side of FIG. 1 in which a periphery of a fixing device C of the image forming apparatus and the discharging device 18 are shown, and details thereof will be described later. Further, the image forming apparatus includes an image forming portion A for forming a toner image on a recording material P, a recording material feeding (sending) portion B for feeding the recording material P to the image forming portion A, and the fixing device C as an image heating apparatus for heat-fixing the toner image on the recording material P.

The image forming portion A includes an electrophotographic photosensitive member (photosensitive drum) 1 which is an image bearing member. The photosensitive drum 1 is rotatably supported by the main assembly M of the image forming apparatus constituting a casing of the image forming apparatus. At a periphery of the photosensitive drum 1, along a rotational direction (counterclockwise direction) shown by an arrow, a charging roller 3, a laser scanner 4, a developing device 5, a transfer roller 6 and a cleaning device 2 are provided in a named order.

The recording material feeding portion B includes sending rollers 10 and 11, and the sending roller rotates at predetermined timing an unshown driving source and sends the recording material P, stacked and accommodated in a cassette 7, to a recording material feeding path. In the image forming apparatus along the fixing device of the recording material P, a top sensor 8, a feeding roller 9, a loop detecting portion 12, a fixing discharging sensor 13, a fixing discharging roller 14, a switching flapper 15, a discharging roller 16 and a discharge tray 17 are provided in a named order.

Further, the image forming apparatus includes a controller 31 which is a control means for controlling the image forming portion A, the recording material feeding portion B, the fixing device C and the like. The controller 31 includes unshown CPU, ROM and RAM, and a control program for effecting speed control or the like described later is stored in the ROM, and the RAM is used for storing data for the control therein. The controller 31 as a first controller controls a driving speed of a driving source for driving the respective rollers for feeding the recording material P on the basis of a detection result obtained from the loop detecting portion 12 described later, and calculates an average speed of feeding speeds of the recording material P on the basis of the driving speed. Further, in the case where the above-described discharging device 18 is mounted, the controller 31 sends speed information and the like to a controller 32 as a second controller for controlling the discharging device 18.

During image formation, a drum motor for driving the photosensitive drum 1 is rotationally driven by the controller 31, so that the photosensitive drum 1 is rotated at a predetermined peripheral speed (hereinafter referred to as process speed) in an arrow direction in FIG. 1. A surface of the rotating photosensitive drum 1 is electrically charged uniformly by the charging roller 3. Then, the surface of the photosensitive drum 1 is exposed to light L by scanning with the light L on the basis of image information by the laser scanner 4, so that electric charges of an exposed portion are removed and thus an electrostatic latent image is formed on the photosensitive drum 1. The developing device 5 includes a developing roller 51, a toner container 52 for accommodating toner, and the like. The toner is rubbed with a member such as a blade and is electrically charged to a predetermined polarity. In the developing device 5, a negative voltage is applied to the developing roller 51 by a developing voltage source (not shown), whereby the toner is deposited on the electrostatic latent image on the surface of the photosensitive drum 1 and thus the electrostatic latent image is developed into a toner image. Then, the toner image formed on the surface of the photosensitive drum 1 is transferred onto the recording material P by using a potential difference based on a transfer voltage by applying a positive voltage, of an opposite polarity to a charge polarity of the toner, to the transfer roller 6.

Further, in synchronism with timing when the toner image formed on the photosensitive drum 1 reaches a transfer nip where the photosensitive drum 1 and the transfer roller 6 contact each other, a driving motor (not shown) provided in the recording material feeding portion B is rotationally driven. Then, the sending roller 10 sends the recording material P from the cassette 7 to the sending roller 11. The sent recording material P is fed by the sending roller 11 and passes through the top sensor 8, and then is fed to a transfer nip formed by contact of the surface of the photosensitive drum 1 with the transfer roller 6. By the above-described application of the transfer voltage to the transfer roller 6, the toner image is transferred from the surface of the photosensitive drum 1 onto the fed recording material P. The recording material P on which the toner image is transferred is fed to the fixing device C while a recording material feeding state is stabilized by the loop detecting portion 12. In the fixing device C, an unfixed toner image on the recording material P is heated and pressed, and thus is fixed on the recording material P. Then, the recording material P on which the toner image is fixed is fed by the fixing discharging roller 14 and the feeding roller 16, and then is discharged onto the discharge tray 17 constituting an upper surface of the main assembly M. The toner remaining on the surface of the photosensitive drum 1 after the toner image is transferred onto the recording material P is removed by a cleaning blade 27 of a cleaning device 2. The image forming apparatus repeats the above-described image forming operation, so that the recording materials P are sequentially subjected to printing. The image forming apparatus in this embodiment in which the fixing device C is mounted is capable of performing the printing at a print speed of 65 sheets/min in the case of A4-sized recording materials P.

The image forming apparatus to which this embodiment is applicable is not limited to the image forming apparatus shown in FIG. 1, but may also be an image forming apparatus such as a color printer including a plurality of image forming portions A, for example. Further, the image forming apparatus may also be an image forming apparatus including a primary transfer portion where the toner image is transferred from the photosensitive drum 1 onto an intermediary transfer belt and a secondary transfer portion where the toner image is transferred from the intermediary transfer belt onto recording paper.

[Fixing Device]

Figure 2:
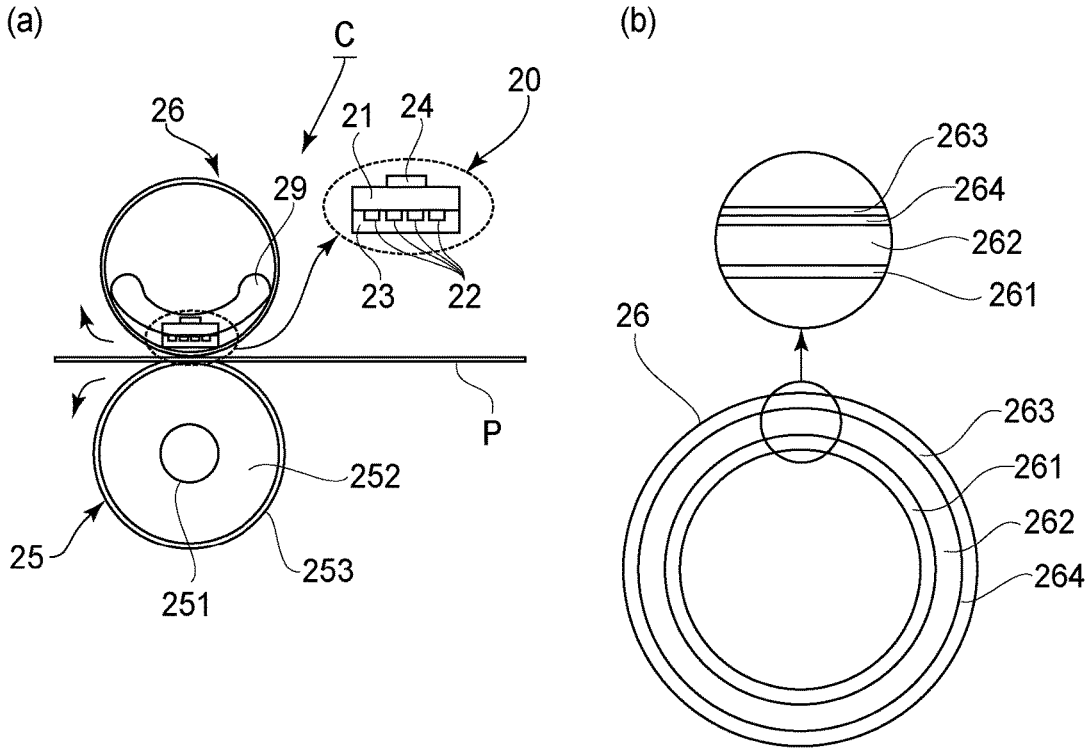
In FIGS. 2,(*a*) and (*b*) are sectional views showing a structure of a fixing device.

The fixing device C which is a fixing portion in this embodiment will be described with reference to FIG. 2. In FIG. 2,(*a*) is a sectional view showing a structure of the fixing device C, and (*b*) is an enlarged schematic view of a structure of a fixing film 26. As shown in (a) of FIG. 2, the fixing device C has a basic structure including a ceramic heater 20 which is a heating member (heater portion), the fixing film 26 as a rotatable heating member and a pressing roller 25 as a rotatable pressing member.

(Heater)

In (a) of FIG. 2, a portion enclosed by a broken line is an enlarged portion showing a structure of the heater 20. The heater 20 includes an elongated heat-resistant heater substrate 21 formed of aluminum nitride, alumina or the like. On a surface of the heater substrate 21, a resistor pattern 22 as a heat generating resistor layer which generates heat by supply of electric power is formed. Further, a surface of the resistor pattern 22 is coated with a ceramic layer 23 for protection. On a back surface of the heater substrate 21, a thermistor 24 which is a temperature detecting member for detecting a temperature of the heater 20 is provided. A heater holder 29 is provided as a member for supporting the heater 20 but is also a member for guiding rotation of the fixing film 26. As a material of the heater holder 29, a heat-resistant resin material such as PPS, PEEK, a liquid crystal polymer or a phenolic resin is used.

(Pressing Roller)

As shown in (a) of FIG. 2, the pressing roller 25 which is a first rotatable member includes a shaft portion 251 at a central portion, an elastic layer 252 formed outside the shaft portion 251, and a surface layer 253 formed outside the elastic layer 252. An outer diameter of the pressing roller 25 is 25 mm. As the shaft portion 251, a solid or hollow metal material such as iron or aluminum is used. In this embodiment, the elastic layer 252 is formed with a heat-resistant silicone rubber, which is made electroconductive by adding therein carbon black in an appropriate amount. Specifically, the elastic layer 252 is constituted by the silicone rubber adjusted to have a volume resistivity of about $1.0\times10^3$-$6.5\times10^4$ (Ω.cm) by adding carbon black into the silicone rubber in an appropriate amount, and a thickness of the elastic layer 252 is 3 mm. The surface layer 253 is a 10-80 μm thick parting tube formed of a fluorine-containing resin material such as PFA (tetrafluoroethylene-perfluoroalkylvinylether copolymer), PTFE (polytetrafluoroethylene) or FEP (tetrafluoroethylene-hexafluoropropylene copolymer).

(Fixing Film)

As shown in (a) of FIG. 2, the fixing film 26 as a heat-resistant endless belt which is a rotatable heating member has a cylindrical shape of 24 mm in diameter. The fixing film 26 has flexibility and is loosely fitted around the heater holder 29 which is an arcuate film guiding member. A structure of the fixing film 26 is constituted by a plurality of layers including a base layer 261, an elastic layer 262 and a surface layer 263 from an inside thereof.

As a material of the base layer 261, polyimide is used. As another material, in order to enhance a heat-conductive property and durability, it is also possible to use SUS or a heat-resistant resin material with low thermal capacity, such as polyamideimide, PEEK or PES. The base layer 261 is required to satisfy not only start agility such that the thermal capacity is made small and a time when a fixing film temperature reaches a fixable temperature is short but also mechanical strength, and therefore as the base layer 261 in this embodiment, a 70 μm-thick cylindrical polyimide (PI) bare tube was used.

Further, the elastic layer 262 is formed of a silicone rubber as a material thereof. By providing the elastic layer 262, the toner image can be covered with the fixing film 26 and heat can be uniformly supplied to the toner image, with the result that it is possible to obtain a good image which has high glossiness and which is free from unevenness. The elastic layer 262 is low in heat-conductive property when the elastic layer 262 is formed of the silicone rubber alone, and therefore a heat-conductive filler is added to the silicone rubber. As thermal conductivity, about 1.2 W/mK may preferably be ensured. As a candidate for the heat-conductive filler, it is possible to cite alumina, metal silicon, silicon carbide, zinc oxide and the like.

The surface layer 263 shown in (b) of FIG. 2, as a parting layer, it is required to have a high anti-wearing property and a high parting property from the toner. For that reason, as a material thereof, the above-described fluorine-containing resin material such as PFA, PTFE or FEP is used. Further, in the fluorine-containing resin material, an ion-conductive material such as an organophosphorus compound or a lithium salt or an electroconductive additive (electron-conductive agent) such as antimony pentoxide, titanium oxide, carbon black or carbon nanofiber is added, so that a resistance value is adjusted. The surface layer 263 may preferably have a thickness of about 10-50 μm and may also be a layer coated with a tube or a layer surface-coated with paint. The surface layer 263 in this embodiment used pure PFA as the fluorine-containing resin material, and was a 14 μm-thick coating layer.

A primary layer 264 shown in (b) of FIG. 2 is an adhesive layer for bonding the surface layer 263 and the elastic layer 262 to each other, and is formed of a fluorine-containing resin primer such as a low-melting point fluorine-containing resin or a fluorine-containing silicone. In the primer layer 264, in order to enhance an adhesive performance, an adhesive component such as a silane coupling agent can also be contained, or it is also possible to add the electron-conductive agent such as carbon black, the ion-conductive agent or an antistatic agent.

(Fixing Discharging Roller)

The fixing (sheet) discharging roller 14 which is a second rotatable member is formed of a heat-resistant silicone, a volume resistivity thereof is adjusted to about $1.0\times10^3$-$3\times10^4$ (Ω.cm) by adding an electroconductive material such as carbon black, so that the (sheet) discharging roller 14 is made electroconductive. The discharging roller 14 is 11 mm in outer diameter, and as a shaft portion thereof, a solid or hollow metal material such as iron or aluminum is used. Further, as a rubber material, EPDM (ethylene-propylene-diene rubber) or TPU (thermoplastic urethane resin elastomer) or the like is used in some cases. Further, as a roller opposing the discharging roller 14, a roller formed of a ROM material is used, and is rotated by rotation of the discharging roller 14.

[Loop Detecting Portion]

Figure 3:
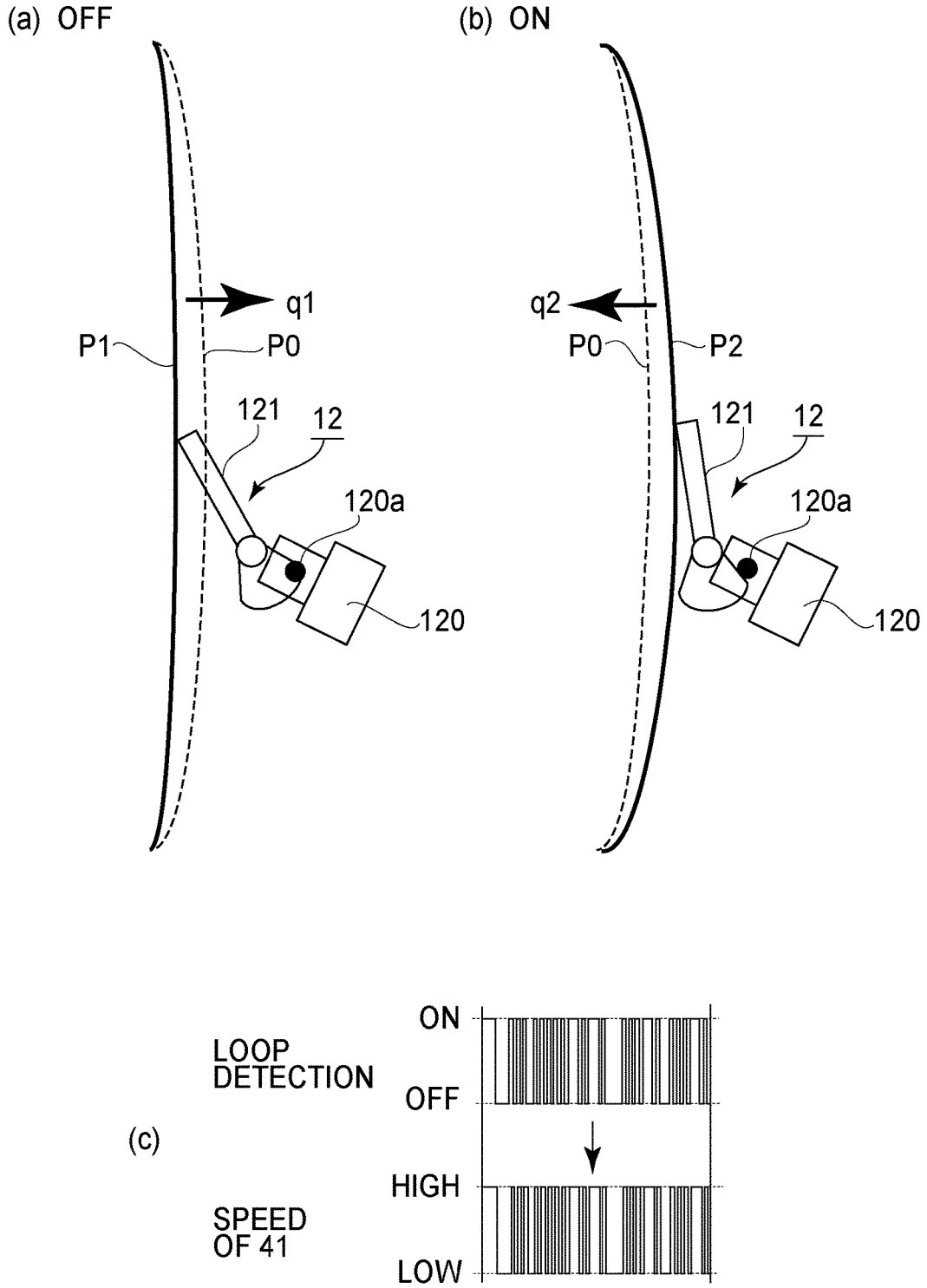
In FIGS. 3,(*a*) to (*c*) are schematic views for illustrating a structure of a loop detecting portion in Embodiment 1.

The loop detecting portion 12 which is a detecting means for detecting an amount of a loop (loop amount) formed on the recording material P will be described with reference to FIG. 3. As shown in (a) and (b) of FIG. 3, the loop detecting portion 12 is constituted by a loop sensor 120 as a sensor portion and a loop sensor flag 121, and detects a loop state formed on the recording material P in a recording material feeding path between the transfer nip and the fixing device C. In (a) of FIG. 3, P1 represents a small loop state of the recording material P, and in (b) of FIG. 3, P2 represents a large loop state of the recording material P. The loop sensor 120 includes a light-emitting portion and a light-receiving portion and detects a state in which a light beam emitted from the light-emitting portion passes through a slit 120*a* and is detected by the light-receiving portion, and then outputs a detection result to the controller 31. In FIG. 3,(*a*)

shows a state in which the slit 120*a* is covered with the loop sensor flag 121 and thus the light beam emitted from the light-emitting portion is blocked, and at this time, the loop sensor 120 outputs an off-signal to the controller 31. On the other hand, (b) of FIG. 3 shows a state in which the loop sensor flag 121 is positioned out of the slit 120*a* and the light beam emitted from the light-emitting portion passes through the slit 120*a* and is received by the light-receiving portion, and at this time, the loop sensor 120 outputs an on-signal to the controller 31.

In this embodiment, the fed recording material P contacts the loop sensor flag 121 and rotates the loop sensor flag 121, so that the loop sensor flag blocks the light beam or permits transmission of the light beam, and thus a feeding state of the recording material P is detected. Incidentally, the loop detecting portion 21 may also be constituted using an optical sensor for directly detecting the feeding state of the recording material P without using the loop sensor flag 121 as in this embodiment.

Further, a position where the loop sensor 120 is provided is, as shown in FIG. 3, in the neighborhood of an intermediary portion between the transfer nip (in a lower end side of the recording material P) and the fixing device C (in an upper end side of the recording material P). This position is not limited to that shown in FIG. 3, but may also be another position where the loop sensor flag 121 contacts the recording material P and can detect the loop state of the recording material P. Incidentally, in each of (a) and (b) of FIG. 3, an ideal line P0 indicated by a broken line is a curve connecting three points consisting of a point of intersection of a tangential line of the transfer nip and a tangential line of the fixing nip formed by contact between the pressing roller 25 and the fixing film 26, a mostdownstream point of the transfer nip and a mostupstream point of the fixing nip. The ideal line P0 shows a state in which the recording material P does not excessively becomes linearly (straightly) between the transfer nip and the fixing nip and does not contact the feeding guide by being excessively flexed. The state of a recording material P1 shown in (a) of FIG. 3 is a state in which the recording material becomes excessively linearly between the transfer nip and the fixing nip, and the state of a recording material P2 shown in (b) of FIG. 3 is a state in which the recording material is excessively flexed between the transfer nip and the fixing nip.

[Loop Control]

Loop control in which a feeding speed of the recording material by the pressing roller 25 is made substantially constant irrespective of an outer diameter fluctuation of the pressing roller 25 by changing a driving speed of the driving source for the pressing roller 25 will be described. The outer diameter of the pressing roller 25 fluctuates by heat conducted from the heater 20 which heats the fixing film 26. For that reason, even when the pressing roller 25 is driven at the same rotational speed (driving speed), the feeding speed at which the pressing roller 25 feeds the recording material P fluctuates. As a result, the loop amount of the recording material P in the feeding path between the transfer nip and the fixing device C fluctuates. That is, when the outer diameter of the pressing roller 25 increases and the feeding speed becomes high, the loop amount decreases, and when the outer diameter of the pressing roller 25 decreases due to a lowering in temperature of the pressing roller 25 and the feeding speed becomes low, the loop amount increases. Therefore, the controller adjusts the feeding speed of the pressing roller 25, i.e., the driving speed of the driving source 41 for driving the pressing roller 25 as described later, and thus effects control so that the loop amount falls within a predetermined range, so that a recording material feeding state is stabilized.

A relationship between a loop detection state of the recording material P by the loop detecting portion 12 and feeding speed control of the recording material P in the fixing device C will be described using (c) of FIG. 3. In (c) of FIG. 3, an upper portion (loop detection) is a schematic view showing an on-signal ("ON") and an off-signal ("OFF") which are outputted from the loop sensor 120. On the other hand, a lower portion (driving speed of driving source 41) is a schematic view showing a state in which a mode of the driving speed of the driving source 41 is switched from a high (speed) mode ("HIGH") or a low (speed) mode ("LOW") depending on the signal outputted from the loop sensor 120. In the case where the loop of the recording material P is not detected by the loop sensor 120, i.e., in the case where the output of the loop sensor 120 is in an off state ((a) of FIG. 3), the loop state of the recording material P1 is linearly. For that reason, on the basis of the off-signal output from the loop sensor 120, the controller 31 changes (the mode of) the feeding speed of the recording material P in the fixing device C to the feeding speed of the recording material P by the transfer roller 6, i.e., the low mode which is a second speed slower than the process speed. As a result, the loop state of the recording material P is shifted in a direction of an arrow q1 ((a) of FIG. 3), so that the loop state becomes large. In this embodiment, the feeding speed of the recording material P in the low mode is 95.3% with respect to the process speed (100%).

On the other hand, the case where the loop of the recording material P is detected by the loop sensor 120, i.e., in the case where the output of the loop sensor 120 is in an on state ((b) of FIG. 3), the loop state of the recording material P1 is a state in which a degree of flection is large. For that reason, on the basis of the on-signal output from the loop sensor 120, the controller 31 changes (the mode of) the feeding speed of the recording material P in the fixing device C to the feeding speed (=process speed) of the recording material P by the transfer roller 6, i.e., the high mode which is a first speed faster than the process speed. As a result, the loop state of the recording material P is shifted in a direction of an arrow q2 ((b) of FIG. 3), so that the loop state becomes small. In this embodiment, the feeding speed of the recording material P in the high mode is 101.3% with respect to the process speed (100%). Thus, on the basis of a detection result of the loop sensor 120, the feeding speed of the recording material P is switched, so that the loop of the recording material P is maintained in a predetermined amount.

Figure 4:
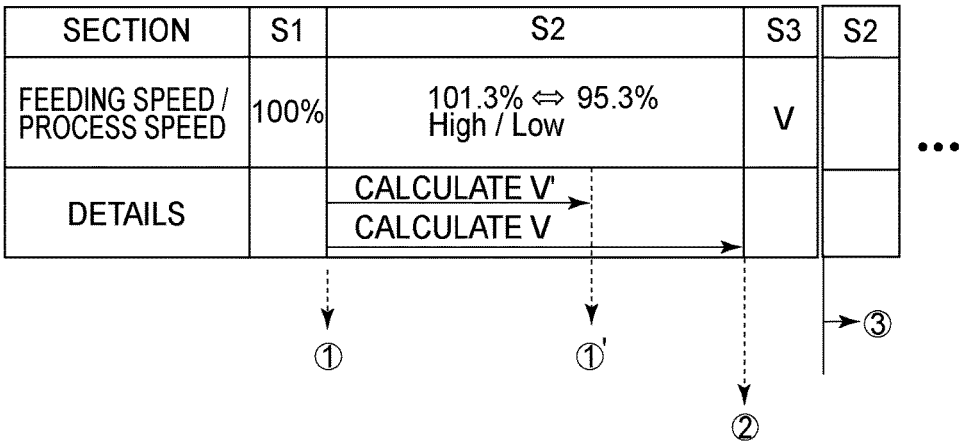
FIG. 4 is a schematic view for illustrating a loop control operation by a controller in Embodiment 1.

A loop control operation by the controller 31 will be described specifically using FIG. 4. FIG. 4 is constituted by "SECTION" showing the feeding state of the recording material P, "FEEDING SPEED/PROCESS SPEED" of the recording material P in each section, and "DETAILS" showing a process by the controller 31. In FIG. 4, circled numerals are used, and in the following a circled numeral 1 and a circled numeral 1' are used, for example.

In a section S1 (section to the circled numeral 1 in FIG. 4) to timing when a leading end of the recording material P enters the fixing nip, the recording material P on which the image is formed at the image forming portion A is fed at the feeding speed of 100% relative to the process speed. Then, in a section S2 (first section) from entrance of the leading end of the recording material P into the fixing nip (circled numeral 1 in FIG. 4) to timing of passing of a trailing end of the same recording material P through the transfer roller 6 (circled numeral 2 in FIG. 4), the controller 31 controls the feeding (state) of the recording material P by switching two feeding speeds. That is, the controller 31 effects feeding control by controlling the driving source 41 described later on the basis of the detection result of the loop state of the recording material P by the loop detecting portion 12 while switching the feeding speed mode of the recording material P to the high mode or the low mode. The feeding speed/process speed of the recording material P is 101.3% in the high mode and is 95.3% in the low mode. Further, the controller 31 calculates an average feeding speed V of the recording material P in an entire section S2. In the case where the discharging device 18 is mounted in the image forming apparatus, the controller 31 calculates an average speed V' at which the recording material P is fed and feeds the average speed V' to a controller 32. The average speed V' is an average feeding speed of the recording material P in a section (second section) from entrance of the leading end of the recording material P into the fixing nip (circled numeral 1 in FIG. 4) to timing of entrance of the leading end of the recording material P into the mostupstream feeding roller of the discharging device 18 in the feeding path (circled numeral 1' in FIG. 4). A section from passing of the trailing end of the recording material P through the transfer roller 6 (circled numeral 2 in FIG. 4) to timing of discharge of the recording material P onto the discharge tray 17 or timing when the leading end of a subsequent recording material P enters the fixing nip (circled numeral 1 in FIG. 4) is a section S3. In the section S3, the controller 31 drives the driving source 41 and thus feeds the recording material P at the average feeding speed V. Then, at timing (circled numeral 3 in FIG. 4) when the leading end of the subsequent recording material P enters the fixing nip, the control of the controller 31 returns to the control in the above-described section S2, so that the above-described operation is repeated until printing is ended.

[Recording Material Discharging Device]

A structure of the discharging device 18 and a feeding operation of the recording material P will be described using a portion (A) in FIG. 1. The discharging device 18 is an external device (option device) capable of being demounted from and mounted into the image forming apparatus, and is positioned downstream of the fixing device C in the recording material feeding path (with respect to the recording material feeding direction). The operation for feeding the recording material P, on which the toner image is transferred at the image forming portion A, to the discharging roller 14 is as described above. In the case where the recording material P is fed toward the discharging device 18 mounted in the image forming apparatus, the feeding direction of the recording material P is switched by a switching flapper 15, so that the recording material P is fed toward the discharging device 18. In the case where the switching flapper 15 extends in a substantially vertical (up-down) direction in FIG. 1, the recording material P is fed toward the discharging device 18. In the case where the switching flapper 15 extends in a horizontal (left-right) direction in FIG. 1, the recording material P is fed to the discharge tray 17 provided in the image forming apparatus side. In the case where the recording material P is fed toward the discharging device 18, the recording material P is delivered to a delivery roller 181, and then the feeding path is branched into two feeding paths by a switching flapper 182 provided in the discharging device 18 side. In the case where the switching flapper 182 extends in an obliquely upward direction, the recording material P is discharged onto a discharge tray 184 after being carried and fed by a feeding roller 183. In the case where the switching flapper 182 extends in the vertical direction, the recording material P is fed in an upward direction along the feeding path shown in FIG. 1. The recording material P fed in the upward direction is carried and fed by a feeding roller 185 and is finally carried and fed by a discharging roller 186, so that the recording material P is discharged onto a discharge tray 187. Further, the feeding paths provided between the discharging roller 14 and the feeding roller 183 provided in the discharging device 18 side are provided with guiding walls J1 to J4 in an order from an upstream side to a downstream side thereof with respect to the recording material feeding direction.

As regards the structure of the discharging device 18, as shown at a portion (B) in FIG. 1, it would be also considered that the delivery roller (feeding roller) 181 is not provided. In the case of the constitution of the portion (B) in FIG. 1, the recording material P is fed by a feeding force thereof by the discharging roller 14 and the feeding roller 185 provided in the image forming apparatus side so as to be guided by the guiding walls J1 to J4 of the feeding paths. Incidentally, in the following, in the case where the recording material P is fed to the discharging device 18, a constitution in which the recording material P is discharged to the discharge tray 184 will be described as a representative example, but also in the case where the recording material P is discharged to the discharge tray 187, the recording material P is fed as described above.

(Feeding Roller)

The feeding rollers (conveying rollers) 181, 183, 185 and 186 provided in the discharging device 18 are constituted by a heat-resistant silicone rubber and are adjusted to have a volume resistivity of $1.0\times10^3$-$3\times10^4$ (Ω.cm) by adding therein an electroconductive agent such as carbon black, so that these feeding rollers are made electroconductive. An outer diameter of each of the feeding rollers 181, 183, 185 and 186 is 12 mm, and a shaft portion of each feeding roller is formed of a solid or hollow metal material such as iron or aluminum. Further, as a rubber material, EPDM (ethylene-propylene-diene rubber) or TPU (thermoplastic polyurethane (resin) elastomer) may also be used. Rollers opposing the feeding rollers 181, 183, 185 and 186 are formed of a POM (thermoplastic polyoxymethylene) material, and are rotated by rotation of the feeding rollers 181, 183, 185 and 186, respectively.

[Feeding Control of Recording Material]

Figure 5:
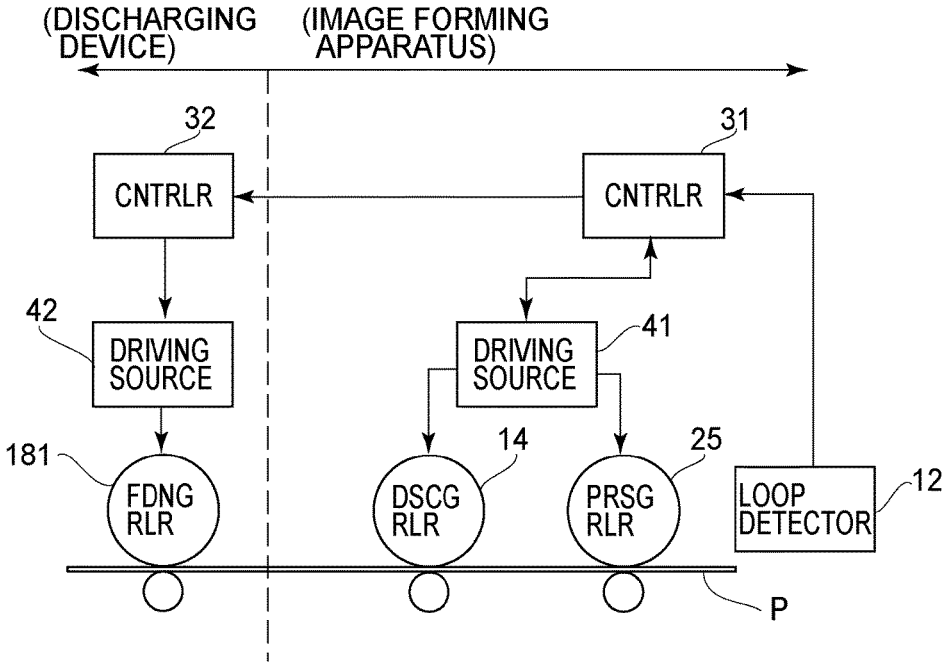
FIG. 5 is a block diagram showing a constitution of recording material feeding control between the image forming apparatus and the discharging device.

First, a constitution relating to control of the feeding speed of the recording material P between the image forming apparatus and the discharging device 18 will be described with reference to the drawings. FIG. 5 is a block diagram showing the constitution relating to the feeding control of the recording material P between the image forming apparatus and the discharging device 18. In the image forming apparatus, the controller 31 controls the drive of the driving source 41 which is a first driving means for driving the pressing roller 25 as the first rotatable member and the discharging roller 14 as the second rotatable member, on the basis of the detection result of the loop detecting portion 12, and thus adjusts the feeding speed of the recording material P. Further, the controller 31 feeds information on the above-described average speed V' of the feeding speed of the recording material P to the controller 32 of the discharging device 18. In this embodiment, the pressing roller 25 and the discharging roller 14 are driven by the driving source 41 which is a single driving source, and therefore driving speeds, i.e., rotational speeds of the pressing roller 25 and the discharging roller 14 are in a proportional relationship. On the other hand, the discharging device 18 is demountable from and mountable into the image forming apparatus, and the controller 32 controls the drive of the driving source 42 as the second driving means for driving the feeding roller 181 as a third rotatable member, on the basis of information on the feeding speed of the recording material P from the controller 31 of the image forming apparatus.

Figure 6:
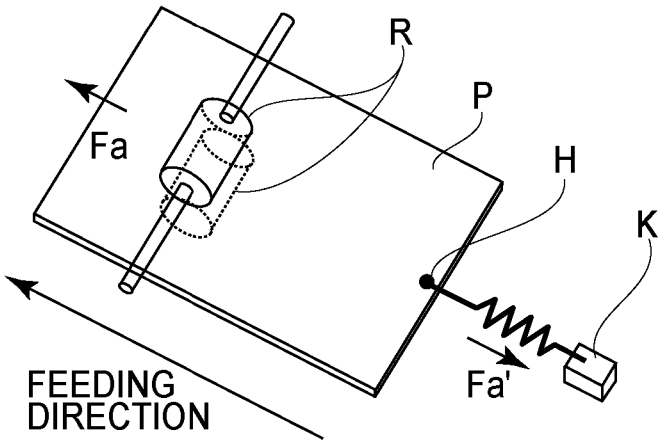
In FIGS. 6,(*a*) and (*b*) are schematic views for illustrating a feeding force relationship among a pressing roller, a discharging roller and a feeding roller.

The feeding speed control of the recording material P between the image forming apparatus and the discharging device 18 will be described with reference to the drawings. In FIG. 6,(*a*) is a schematic view showing a magnitude relationship of feeding forces among the rollers for feeding the recording material P in the image forming apparatus and the discharging device 18. In (a) of FIG. 6, the feeding force of the pressing roller 25 of the fixing device C of the image forming apparatus is F1, the feeding force of the discharging roller 14 of the image forming apparatus is F2, and the feeding force of the feeding roller 181 of the discharging device is F3. The magnitude relationship among the feeding forces F1, F2 and F3 will be described later. In FIG. 6,(*b*) is a schematic view for illustrating a measuring method of the feeding forces shown in (a) of FIG. 6. In (b) of FIG. 6, a state in which the recording material P is nipped between a roller pair R (e.g., the pressing roller 25 and the fixing film 26) to be subjected to the measurement is formed. Then, the recording material P is provided with a hole H at a trailing end portion thereof with respect to the feeding direction, and a hook of a force gage K is hooked (engaged) in the hole H. Then, in this state, the roller pair R is driven, a feeding force Fa of the roller pair R and a reaction force Fa' by the force gage K are balanced with each other. In this state in which the recording material P is not fed, the force Fa' by the force gage K is defined as a feeding force F of the roller pair F.

Figure 7:
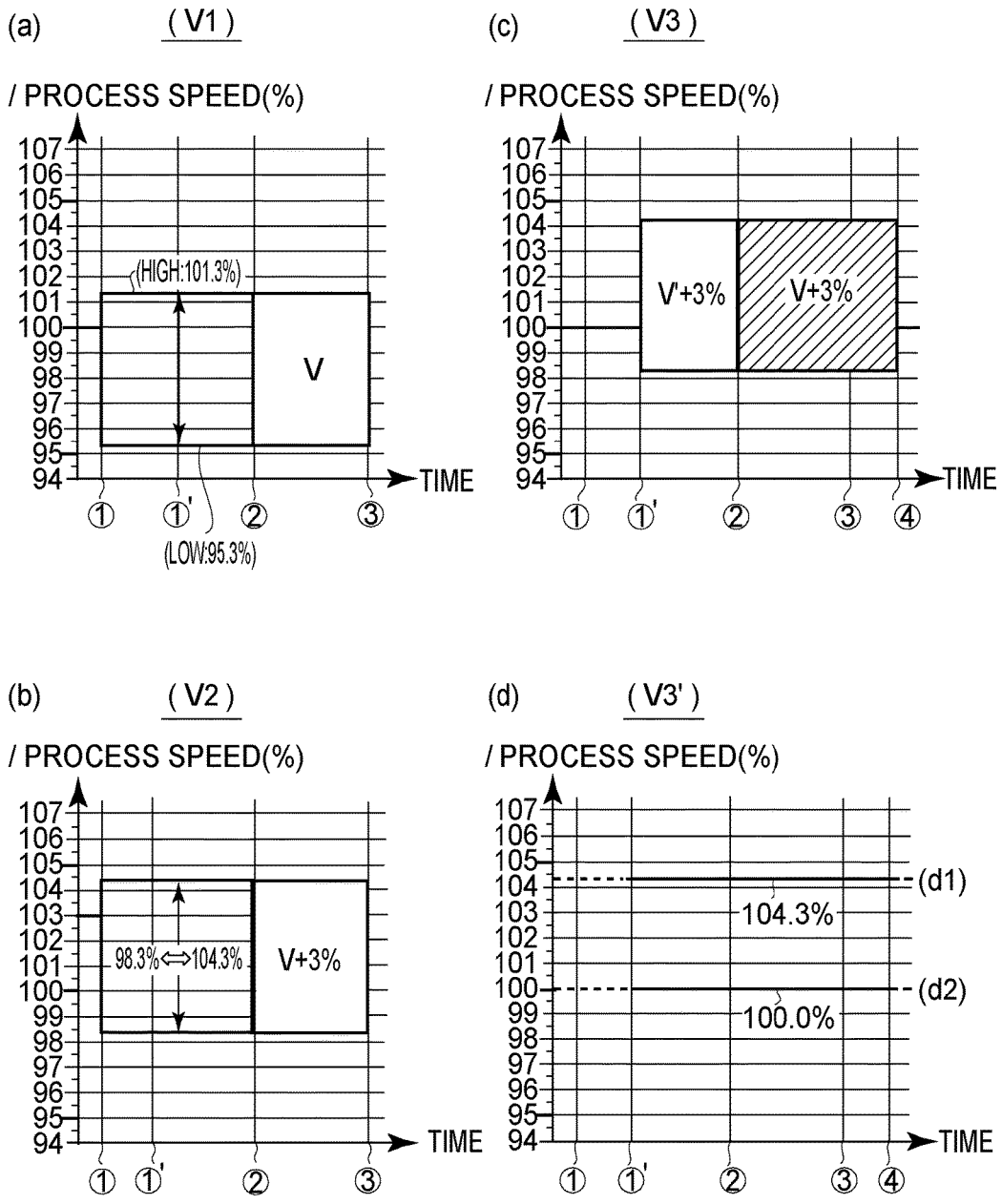
In FIGS. 7,(*a*) to (*d*) are graphs for illustrating changes in feeding speeds of the pressing roller, the discharging roller, the feeding roller and a feeding roller in a conventional example, respectively.

Next, a feeding speed relationship among the pressing roller 25 of the fixing device C, the discharging roller 14 and the feeding roller 181 will be described with reference to FIG. 7. In FIG. 7, (a) is a graph showing a change in feeding speed V1 of the pressing roller 25 of the fixing device C, (b) is a graph showing a change in feeding speed V2 of the discharging roller 14, and (c) is a graph showing a change in feeding speed V3 of the feeding roller 181. In each of (a), (b) and (c) of FIG. 7, the ordinate represents a feeding speed of each roller (unit: %) when the process speed is 100% ("/PROCESS SPEED (%)"), and the abscissa represents a time ("TIME"), i.e., timing when the driving speed of the driving source 41 or 42 described later is changed. In this embodiment, the feeding speed of the recording material P when the process speed is 100% is 370 mm/sec.

A relationship between the feeding speed V1 of the pressing roller 25 of the fixing device C and the feeding speed V2 of the discharging roller 14 will be described. In the abscissa of (a) and (b) of FIG. 7, timing when the driving speed of the driving source 41 is changed is indicated by circled numerals. In these figures, a circled numeral 1 shows timing when the leading end of the recording material P reaches the fixing nip, a circled numeral 2 shows timing when the trailing end of the recording material P passes through the transfer roller 6, and a circled numeral 3 shows an end of printing or timing when the leading end of the subsequent recording material P enters the fixing nip. In (c) and (d) of FIG. 7, a circled numeral 4 shows timing when the trailing end of the recording material P passes through the fixing discharging roller 14.

As described above, the controller 31 repeats setting of the driving speed of the driving source 41 to two values in the high mode and the low mode, so that the feeding speed V1 of the pressing roller 25 is maintained at a certain speed. That is, the pressing roller 25 is heated by heat conducted from the fixing film 26 which is a heat source and is fluctuated in outer diameter, whereby the feeding speed for feeding the recording material P fluctuates even at the same driving speed (rotational speed). For that reason, the controller 31 switches the mode of the driving speed of the driving source 41 for driving the pressing roller 25 to high mode (101.3% of the process speed) or the low mode (95.3% of the process speed) depending on the loop state of the recording material P. As a result, the feeding speed V1 of the recording material P by the pressing roller 25 is kept at a certain speed.

On the other hand, the discharging roller 14 driven by the same driving source as the pressing roller 25 is, different from the pressing roller 25, little influenced by the heat from the fixing film 26, and therefore a degree of the fluctuation in outer diameter is small. As a result, depending on the fluctuation of the driving speed of the driving source 41, the feeding speed V2 of the recording material P by the discharging roller 14 largely changes, so that a peripheral speed difference generates between the feeding speed V1 and the feeding speed V2 in some cases. In the case where the recording material feeding speed V1 of the pressing roller 25 is higher than the recording material feeding speed V2 of the discharging roller 14, a loop of the recording material P generates between the pressing roller 25 and the discharging roller 14, so that a waving phenomenon generates. The waving phenomenon is such a phenomenon that the recording material P waves and loses its smoothness. In order to avoid this phenomenon, the magnitude relationship between the feeding speeds V1 and V2 is set at V2>V1 so that the feeding speed V2 is very higher than the feeding speed V1. Further, by setting the feeding speed relationship at V2>V1, the discharging roller 14 pulls the recording material P fed by the pressing roller 25. For that reason, when the discharging roller 14 excessively pulls the recording material P, there is a liability that abrasion of the fixing film 26 by an edge portion of the recording material P and improper fixing of the toner image due to a decrease in passing time of the recording material P through the fixing device C generate. Therefore, in order to avoid these influences, the magnitude relationship between the recording material feeding force F1 of the pressing roller 25 and the recording material feeding force F2 of the discharging roller 14 are set at F1>F2 in which the feeding force F1 is very larger than the feeding force F2 ((a) of FIG. 6). In this embodiment, the relationship between the feeding speeds V1 and V2 is set so as to satisfy: V2≥V1+3%. Due to the thermal expansion of the pressing roller 25, even at the same driving speed, the feeding speed of the pressing roller 25 is higher than the feeding speed of the discharging roller 14 by about 3% which is a predetermined proportion (percentage), but the predetermined proportion is not limited to +3%. The predetermined proportion may only be required to be determined in view of a balance with the relationship between the feeding forces F1 and F2.

Next, a relationship between the feeding speed V2 of the discharging roller 14 driven by the driving source 41 and the feeding speed V2 of the feeding rollers 181, 185 and 186 of the discharging device 18 driven by the driving source 42 will be described. In the following, only the mostupstream feeding roller 181 in the feeding path of the recording material P in the discharging device 18 will be described as a representative example, but is also true for other feeding rollers 183, 185 and 186. In (a) and (b) of FIG. 7, a circled numeral 1' shows timing when the leading end of the recording material P enters the mostupstream feeding roller 181 of the discharging device 18, and in (c) of FIG. 7, a circled numeral 4 shows timing when the trailing end of the recording material P passes through the fixing discharging roller 14. As shown in FIG. 5, the driving source for driving the feeding roller 181 is the driving source 42 and is different from the driving source 41 for driving the discharging roller 14.

Accordingly, the driving speed of the driving source 41 changes depending on the detection result of the loop detecting portion 12, so that even when the feeding speed V2 of the discharging roller 14 fluctuates, the feeding speed V3 of the feeding roller 181 of the discharging device 18 is unchanged.

Here, between the feeding roller 181 of the discharging device 18 and the discharging roller 14, in order that the recording material P is not excessively pulled at all times and that the loop (flection) is not excessively accumulated at all times, it is ideal that the relationship between the feeding speeds V2 and V3 is set at the following relationship. That is, the relationship between the feeding speeds V2 and V3 is set at V2=V3, so that the recording material feeding speeds of the respective rollers are made equal to each other. In FIG. 7,(*d*) is a graph showing the feeding speed of the feeding roller 181 of the discharging device 18 in feeding control of the recording material P in conventional examples, in which the abscissa and the ordinate are similar to those in (a) to (c) of FIG. 7. Conventionally, the feeding speed of the feeding roller 181 of the discharging device 18 was, as shown in (d) of FIG. 7, set at a fixed feeding speed V3' irrespective of the speed fluctuation of the feeding speed V2 of the discharging roller 14. Accordingly, in the case where the feeding speed V3' is fixed at 104.3% of the process speed as in a conventional example (d1) shown in (d) of FIG. 7, a peripheral speed difference of 6% (=104.3%−98.3%) generates between itself and the feeding speed V2 (=98.3%=V+3%) of the discharging roller 14 at the maximum. As a result, the recording material P is pulled between the feeding roller 181 and the discharging roller 14, so that an influence due to friction of the recording material P with the feeding path as described above generates. On the other hand, in the case where the feeding speed V3' is fixed at 100% which is equal to the process speed as in a conventional example (d2) shown in (d) of FIG. 7, a peripheral speed difference of 4.3% (=104.3%−100%) generates between itself and the feeding speed V2 of the discharging roller 14 at the maximum. As a result, the loop of recording material P is excessively accumulated between the feeding roller 181 and the discharging roller 14, so that an influence due to the friction of the recording material P with the feeding path generates. Incidentally, an influence generating due to a peripheral speed relationship between the discharging roller 14 and the feeding roller 181 of the discharging device 18 will be described later in detail.

Next, a relationship among the feeding force F3 and the feeding forces F1 and F2 will be described. As described above, the feeding force F2 of the discharging roller 14 is set so as to be weaker than the feeding force F1 of the pressing roller 25 (F1>>F2). In the case where when the discharging device 18 is mounted, the weak feeding force F2 of the discharging roller 14 is dominant over the feeding force F3 of the feeding roller (e.g., the feeding roller 181) of the discharging device 8 (F2>F3), the feeding force F2 is insufficient for feeding a recording material having a large basis weight, such as thick paper or OHT. For that reason, the feeding force F3 of the feeding roller is set at a large value, so that an insufficient feeding force is avoided (F3>F2) ((a) of FIG. 6). Incidentally, when the feeding force F3 of the feeding roller of the discharging device 18 is made stronger than the feeding force F1 of the pressing roller 25 (F1<F3), the feeding force of the roller downstream of the pressing roller 25 becomes larger than the feeding force F1 of the pressing roller 25. For that reason, the feeding roller of the discharging device 18 excessively pulls the recording material P fed by the pressing roller 25 similarly as in the case of the influence of the setting of F2>F1 as the relationship between the feeding force F2 of the discharging roller 14 and the feeding force F1 of the pressing roller 25. As a result, there is a liability that abrasion of the fixing film by an edge portion of the recording material P and improper fixing of the toner image due to a decrease in passing time of the recording material P through the fixing device C generate. Therefore, in order to avoid these influences, setting that the feeding force F3 of the feeding roller of the discharging device 18 is very weaker than the feeding force F1 of the pressing roller (F1>>F3). From the above, the magnitude relationship among the feeding forces F1, F2 and F3 is F1>F3>F2.

The feeding speed V3 of the feeding rollers 181, 183, 185 and 186 of the discharging device 18 when the discharging device 18 is mounted in the image forming apparatus will be described with reference to (b) and (c) of FIG. 7. In the following, only the feeding roller 181 will be described, but other feeding rollers 183, 185 and 186 are also similarly operated at the same timing as that of the case of the feeding speed of the feeding roller 181. As shown in (c) of FIG. 7, the feeding speed V3 of the feeding roller 181 is 100% relative to the process speed to timing when the leading end of the recording material P enters the feeding roller 181 (circled numeral 1' in (c) of FIG. 7). The controller 31 calculates an average speed V of the feeding speed V1 of the pressing roller 25 from the timing when the leading end of the recording material P enters the fixing nip (circled numeral 1 in (b) of FIG. 7) to timing when the leading end of the recording material P enters the feeding roller 181 (circled numeral 1' in (b) of FIG. 7). Then, the controller 31 feeds speed information of the average feeding speed V to the controller 32 of the discharging device 18, and the controller 32 controls the driving speed of the driving source 42, so that the driving source 42 drives the feeding roller 181 so as to have the feeding speed V3 =V' +3% ((c) of FIG. 7). Then, when the trailing end of the recording material P passes through the transfer roller 6 (circled numeral 2 in (b) of FIG. 7), the controller 31 calculates the average speed V of the feeding speed V1 of the pressing roller 25 and feeds speed information of the average feeding speed V to the controller 32. The controller 32 receives the speed information of the average feeding speed V from the controller 31, and then drives the feeding roller 181 at the feeding speed V3 =V +3% ((c) of FIG. 7). At this time, the feeding speed V3 is set at a value at which a speed difference between itself and the feeding speed V2 of the discharging roller 14 is substantially eliminated. This setting is made for the purpose of stabilizing a feeding state of the recording material P, and +3% is an example, and this value may only be required to be determined on the basis of the speed difference between the pressing roller 25 and the discharging roller 14 and the feeding forces of the respective rollers. In this embodiment, the feeding speed V2 of the discharging roller 14 is V2 =V1 (feeding speed of the pressing roller 25) +3%. As a relationship among the feeding speed V3 of the feeding roller of the discharging device 18, the feeding speed V2 of the discharging roller 14 and the feeding speed V1 of the pressing roller 25 is V3 =V2 =V1 +3%. Thereafter, the feeding roller of the discharging device 18 operates at the feeding speed V3, and in the case where there is a subsequent recording material P, when the trailing end of the currently fed recording material P passes toner the discharging roller 14, the feeding speed is changed again to the feeding speed which is 100% of the process speed, and then the above-described operation is repeated. In the case where there is no subsequent recording material P, all the feeding rollers of the discharging device 18 operate at the feeding speed V3 =V +3% to the end of the printing.

[Flowchart of feeding control]

Figure 8:
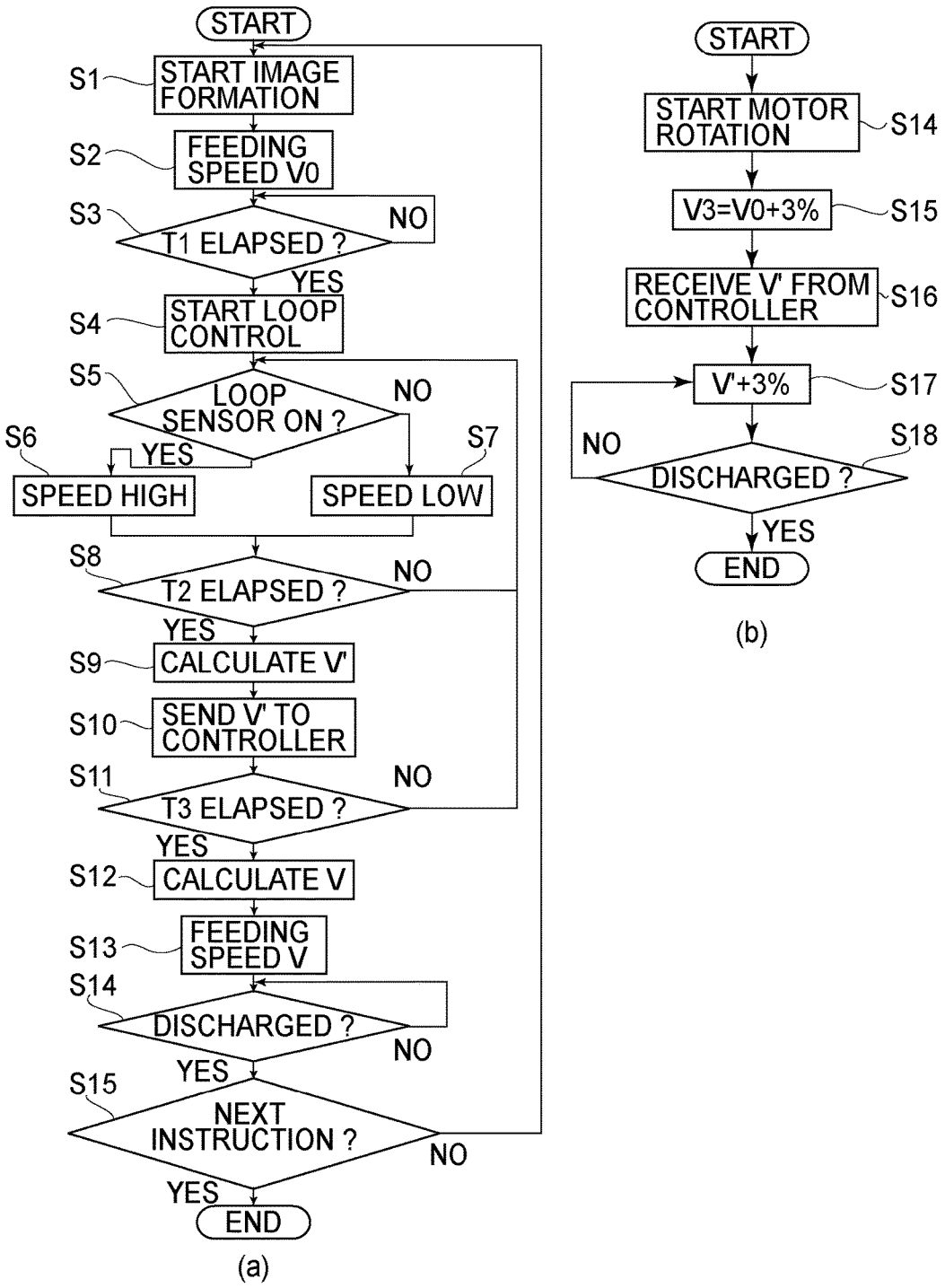
In FIGS. 8,(*a*) and (*b*) are flowcharts of feeding control in Embodiment 1.

A flowchart of the feeding control of the recording material P in this embodiment is shown in FIG. 8. Control based on the flowchart shown in (a) of FIG. 8 is executed by the controller 31 of the image forming apparatus on the basis of a program stored in the ROM or the like. Control based on the flowchart shown in (b) of FIG. 8 is executed by the controller 32 of the discharging device 18 on the basis of a program stored in the ROM or the like.

First, the flowchart of (a) of FIG. 8 will be described. The controller 31 feeds the recording material P from the cassette 7 and starts the image forming operation (S1). Then, the controller 31 controls the driving speed of the driving source 41 and thus sets the feeding speed of the recording material P by the pressing roller 25 at V0 (S2). V0 is the feeding speed which is 100% of the process speed.

The controller 31 discriminates whether or not a first predetermined time T1 has elapsed from start of the image formation (S3). The first predetermined time T1 is set correspondingly the process speed corresponding to the feeding speed of the recording material P and is a time required until the leading end of the recording material P enters the fixing nip. When the controller 31 discriminated that the first predetermined time T1 elapsed, the controller 31 starts loop control of the recording material P by the loop detecting portion 12 (S4). That is, in the case where the loop detecting portion 12 is turned on (S5), the controller 31 sets the feeding speed of the recording material P by the pressing roller 25 at a high speed (S6), and in the case where the loop detecting portion 12 is turned off (S5), the controller 31 sets the feeding speed of the recording material P by the pressing roller 25 at a low speed (S7).

The controller 31 discriminates whether or not a second predetermined time T2 has elapsed from the start of the image formation (S8). The second predetermined time T2 is set correspondingly to the process speed for the recording material P and is a time required until the leading end of the recording material P enters the mostupstream feeding roller of the discharging device 18. When the controller 31 discriminated that the second predetermined time T2 elapsed, the controller 31 calculates the average feeding speed V' in the previous and current sections (S9). The controller 31 sends information on the calculated average feeding speed V' to the controller 32 of the discharging device 18 (S10).

The controller 31 discriminates whether or not a third predetermined time T3 has elapsed from the starts of the image formation (S11). The third predetermined time T3 is a time required until the trailing end of the recording material P passes through the transfer roller 6. When the controller 31 discriminated that the third predetermined time T3 elapsed, the controller 31 ends the loop control and calculates the average feeding speed V in the previous and current sections (S12). Then, the controller 31 controls the driving speed of the driving source 41, and sets the feeding speed of the recording material P by the pressing roller 25 at the calculated average feeding speed V (S13). The controller 31 discriminates whether or not the recording material P is discharged from the image forming apparatus (S14), and when the controller 31 discriminated that the recording material P was discharged, the controller 31 checks whether or not a subsequent image forming instruction is provided (S15). In the case where the subsequent image forming instruction is provided, the process of the controller 31 returns to S1. In the case where the subsequent image forming instruction is not provided, the control in this flowchart is ended.

The flowchart of (b) of FIG. 8 will be described. The controller 32 starts rotation of the driving source 42 (S14), and sets the feeding speed of the recording material P by the feeding roller 181 at V3 (S15). V3 is the above-described feeding speed V3=V0+3%. When the controller 32 receives information on the average feeding speed V' from the controller 31 of the image forming apparatus (S16), the controller 32 controls the driving speed of the driving source 42, and sets the feeding speed of the recording material P by the feeding roller 181 at V'+3% (S17). The controller 32 discriminates whether or not the recording material P is discharged from the discharging device 18 (S18), and when the controller 32 discriminated that the recording material P was discharged from the discharging device 18, the controller 32 ends the control of this flowchart.

(Comparison Evaluation of Embodiment 1 and Conventional Examples)

Figure 9:
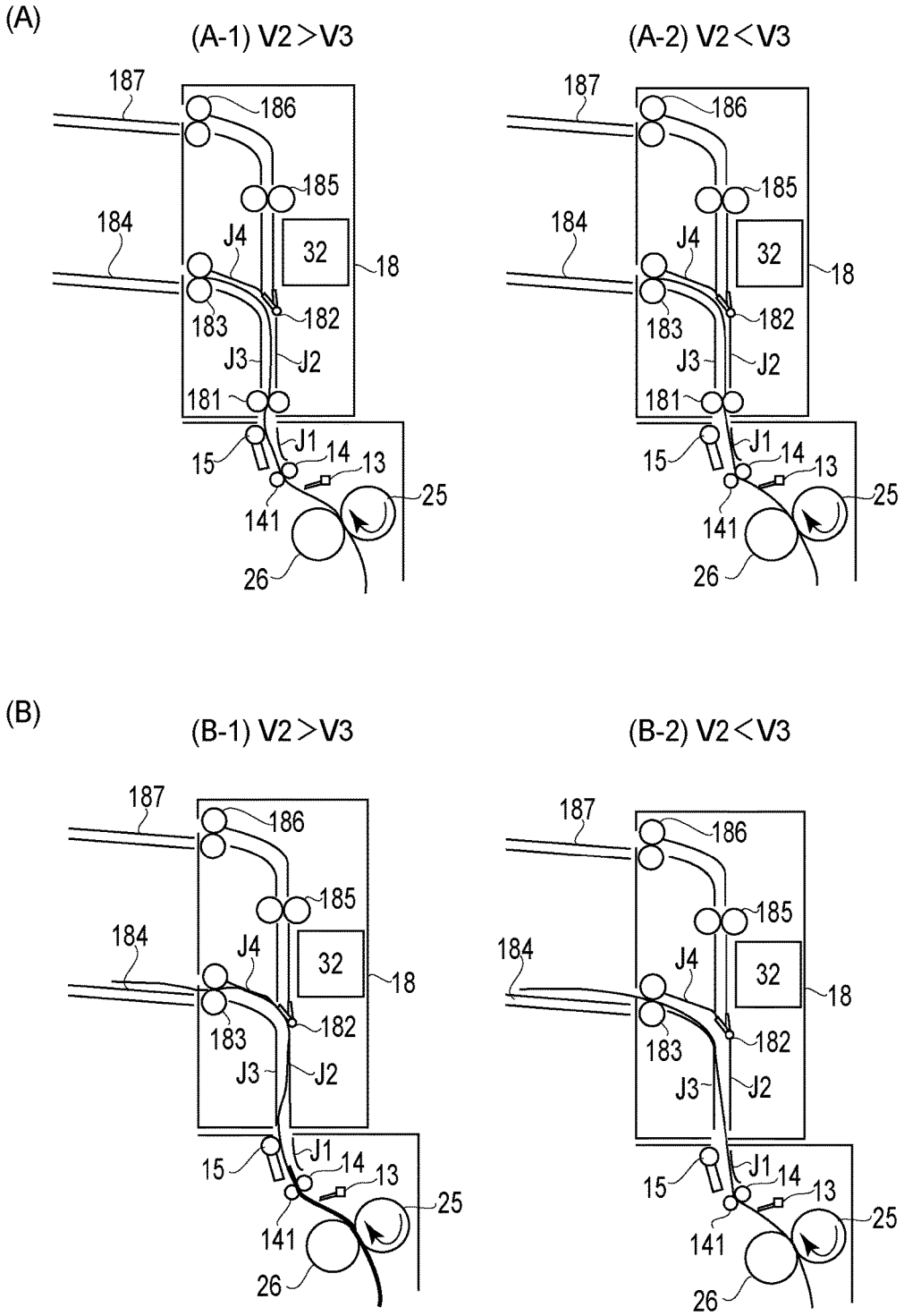
In FIGS. 9, (A-1), (A-2), (B-1) and (B-2) are schematic views each for illustrating a peripheral speed difference between the discharging roller and the feeding roller and a recording material feeding state.

As described above, in this embodiment, the feeding speed V2 of the discharging roller 14 and the feeding speed V3 of the feeding roller of the discharging device 18 are speeds such that there is substantially no speed difference, but in the following, a feeding state in which there is a speed difference between the two feeding speeds V2 and V3 will be described. FIG. 9 includes schematic views for illustrating the case of a relationship of V2>V3 and the case of a relationship of V3>V2, between the feeding speed V2 of the discharging roller 14 and the feeding speed V3 of the feeding roller of the discharging device 18. In FIG. 9, (A) is the schematic view showing the case where the feeding roller 181 is provided, and (B) is the schematic view showing the case where the feeding roller 181 is not provided.

First, with reference to (A) of FIG. 9, the case where the feeding roller 181 is provided will be described. In the case where the feeding speed V3 of the feeding roller 181 of the discharging device 18 shown in (A-1) of (A) of FIG. 9 is slower than the feeding speed V2 of the discharging roller 14 (V2>V3), the loop of the recording material P becomes large between the discharging roller 14 and the feeding roller 181. As a result, the recording material P strongly slides with the switching flapper 15 also functioning as the feeding path, so that there is a liability that image deficiency due to peeling-off of the toner on the recording material P in an image forming surface side and contamination of the fixing device with the toner due to scattering of the peeled toner into the fixing device generate. Further, by the slide of the recording material P with the feeding path, back tension is applied to the feeding roller 181 of the discharging device 18 and the discharging roller 14 and thus the feeding forces of the respective rollers lower, so that there is a liability that paper jam occurs.

On the other hand, in the case where the feeding speed V3 of the feeding roller 181 of the discharging device 18 shown in (A-2) of (A) of FIG. 9 is faster than the feeding speed V2 of the discharging roller 14 (V3 >V2), the recording material P is pulled by the feeding roller 181 of the discharging device 18 and slides with the guiding wall J1 of the feeding path. By this slide of the recording material P, back tension is applied to the recording material P and thus the feeding forces of the feeding roller 181 of the discharging device 18 and the discharging roller 14 lower, so that the paper jam occurs in some instances.

Next, with reference to (b) of FIG. 9, the case where the feeding roller (delivery roller) 181 is provided will be described. In the case where the feeding speed V3 of the feeding roller 183 of the discharging device 18 shown in (B-1) of (B) of FIG. 9 is slower than the feeding speed V2 of the discharging roller 14 (V2>V3), the recording material P is pushed in a direction of the feeding roller 183 by the discharging roller 14. As a result, the loop of the recording material P accumulates and the recording material P strongly slides with the switching flapper 15 also functioning as the feeding path and with the guiding walls J3, J2 and J4. In the case where the recording material P slides with the switching flapper 15 and the guiding wall J3, image deficiency due to the strong slide of the recording material P in an image forming surface side and contamination of the feeding path with the peeled toner generate in some cases. Further, by the slide of the recording material P with the switching flapper 15 and the guiding walls J3, J2 and J4, particularly in the case where the recording material P is the recording material having high rigidity such as thick paper, a force for pulling the recording material P toward the discharging roller 14 low in feeding force acts on the recording material P, so that the feeding force of the discharging roller 14 lowers. As a result, there is a liability that paper jam occurs.

On the other hand, in the case where the feeding speed V3 of the feeding roller 183 of the discharging device 18 shown in (B-2) of (B) of FIG. 9 is faster than the feeding speed V2 of the discharging roller 14 (V3>V2), the recording material P is pulled by the feeding roller 183 of the discharging device 18. As a result, the recording material P is linearly fed between the feeding roller 183 and the discharging roller 14. As shown in (B) of FIG. 9, in the case where the feeding path between the two rollers is flexed (bent), the recording material P slides with the guiding wall J3 of the feeding path and is strongly slid in the image forming surface side, so that there is a liability that the image deficiency generates. Further, by the slide of the recording material P with the guiding walls J1 and J3 of the feeding path, back tension is applied to the feeding roller 183 of the discharging device 18 and the feeding force lowers, so that the paper jam occurs in some instances.

Then, evaluation results as to a generation frequency of the image defect due to the slide of the recording material and a generation frequency of the paper jam in the constitution in this embodiment are shown in Tables 1 and 2 together with evaluation results in conventional examples. Evaluation in this embodiment shown in Tables 1 and 2 was made using the constitution of the portion (B) of FIG. 1 in which the image defect and the paper jam are liable to generate. Table 1 shows the evaluation result as to the generation frequency of the image defect due to the slide of the recording material every paper species of the recording material P, in which a left-hand table shows the evaluation result in the case where plain paper or thin paper is used, and a right-hand table shows the evaluation result in the case where thick paper is used. Similarly, Table 2 shows the evaluation result as to the generation frequency of the paper jam every paper species of the recording material P, in which a left-hand table shows the evaluation result in the case where the plain paper or the thin paper is used, and a right-hand table shows the evaluation result in the case where the thick paper is used.

The constitutions in the respective tables are the same. In a leftmost column, a ratio (%) of the feeding speed to the process speed ("FIXING DISCHARGE RATIO" in the table) and is 98%, 100%, 102% and 104% with an increment of 2%. Incidentally, the feeding speed of the discharging roller 14 is controllable in a range from 98.3% to 104.3%, which are the associated calculated values +3% as described above, so as to change in increments of 0.1%. On the other hand, other three columns are those corresponding to the feeding speeds of the feeding roller 181 or the like of the discharging device 18. The second column from the leftmost column shows the evaluation result in the case where the feeding speed control of the feeding roller in this embodiment was effected. The right-hand two columns show the evaluation result in the case where the feeding speed of the feeding roller of the discharging device 18 was the fixed speed ("FIXED SPEED" in the table) described with reference to (d) of FIG. 7 in the conventional examples. The fixed speed in the case of the conventional examples was 100% and 104% relative to the process speed. The evaluation was made as follows. In Table 1, "o" represents no generation of the image defect, "Δ" represents that the toner on the recording material P was peeled off by being slid with the guiding wall of the feeding path of the discharging device 18 and slight image defect generated, and "x" represents that serious image defect practically generated. On the other hand, in Table 2, the evaluation result of the number of times of generations of the paper jam resulting from the passing of 1000 sheets of the recording material P through the discharging device 18, in which "o" represents that the number of paper jam generation times is 0, "Δ" represents that the number of paper jam generation times is less than 5, and "x" represents that the number of paper jam generation times is not less than 5.

TABLE 1

| <PP/TNP*1> DDS*2 | | | |
|---|---|---|---|
| | | CE(FS) *4 | |
| FDR*3 | EMB. 1 | 100% | 104% |
| 98% | ○ | ○ | x |
| 100% | ○ | ○ | Δ |
| 102% | ○ | Δ | ○ |
| 104% | ○ | x | ○ |

| <TKP*1> DDS*2 | | | |
|---|---|---|---|
| | | CE(FS)*4 | |
| FDR*3 | EMB. 1 | 100% | 104% |
| 98% | ○ | ○ | x |
| 100% | ○ | ○ | x |
| 102% | ○ | ○ | Δ |
| 104% | ○ | Δ | ○ |

*1"PP/TNP" is plain paper or thin paper.

*2"DDS" is a discharging device speed.

*3"FDR" is a feeding discharge ratio.

*4 "CE(FS)" is a conventional example (fixed speed).

*5"TKP" is thick paper.

TABLE 2

| <PP/TNP*1> DDS*2 | | | |
|---|---|---|---|
| | | CE(FS)*4 | |
| FDR*3 | EMB. 1 | 100% | 104% |
| 98% | ○ | ○ | x |
| 100% | ○ | ○ | Δ |
| 102% | ○ | ○ | ○ |
| 104% | ○ | Δ | ○ |

| <TKP*1> DDS*2 | | | |
|---|---|---|---|
| | | CE(FS)*4 | |
| FDR*3 | EMB. 1 | 100% | 104% |
| 98% | ○ | ○ | Δ |
| 100% | ○ | ○ | Δ |
| 102% | ○ | ○ | Δ |
| 104% | ○ | Δ | ○ |

*1"FF/TNP" is plain paper or thin paper.
*2"DDS" is a discharging device speed.
*3"FDR" is a feeding discharge ratio.
*4 "CE(FS)" is a conventional example (fixed speed).
*5"TKP" is thick paper.

From Table 1, it is understood that the image defect generates due to the slide of the recording material P with the guiding wall in the case where the feeding speed of the feeding roller of the discharging device in the conventional example is a fixed speed, but does not generate by effecting the above-described feeding speed control of the rollers in the case of Embodiment 1. Further, also from Table 2, it is understood that the paper jam generates in the case where the feeding speed of the feeding roller of the discharging device in the conventional example is the fixed speed, but does not generate by effecting the above-described feeding speed control of the rollers in the case of Embodiment 1. That is, from Tables 1 and 2, it is understood that the recording material P is prevented from contacting the guiding wall of the recording material feeding path by the feeding speed control of the rollers and thus degrees of the image defect due to the slide of the recording material P and the paper jam decreases.

As described above, according to this embodiment, the average speed information of the recording material feeding by the loop control between the transfer portion and the fixing device is fed back to the discharging device, so that the loop of the recording material is maintained at a certain amount between the discharging roller and the feeding roller of the discharging device. That is, the information on the feeding speed of the discharging roller of the image forming apparatus is fed from the controller of the image forming apparatus to the controller of the discharging device, and then the controller of the discharging device provides an instruction of the feeding speed of the feeding roller of the discharging device depending on the fed feeding speed. As a result, the loop of the recording material is maintained at a certain amount and a feeding property of the recording material between the fixing discharging roller and the discharging device feeding roller is stabilized, so that it is possible to suppress the generation of the paper jam and reduce degrees of damage on the recording material and the generation of the image defect.

Further, the loop detecting portion is provided downstream of the fixing device, so that there is no need to provide an additional member and extend a width of the feeding path, and thus an increase in cost does not generate. In addition, no sensor is used and the feeding path is shortened and reduced, so that also a space reduction effect in the image forming apparatus can be expected and thus leads to downsizing of the image forming apparatus.

As described above, it is possible to stabilize the feeding state of the recording material between the image forming apparatus and the discharging device.

(Embodiment 2)

In Embodiment 1, the constitution in which the controller 31 calculates the average value of the feeding speed of the pressing roller 25 to be controlled on the basis of the detection result by the loop detecting portion 12 and then feeds the calculated average feeding speed value to the controller 32 provided in the discharging device 18 side, and the controller 32 of the discharging device 18 controls the feeding speed of the feeding roller 181 and the like was described. In Embodiment 2, a constitution in which in the case where the image forming apparatus is not provided with the loop detecting portion 12 in the image forming apparatus, the feeding speed of the discharging device 18 is controlled depending on a degree of heating of the pressing roller 25 by the heat from the heater 20 will be described.

[Degree of Heating of Fixing Device and prediction by Fixing Counter]

First, the degree of heating of the pressing roller 25 will be described. In general, it is known that the heat generated by the heater 20 heats the unfixed toner image on the recording material and fixes the toner image on the recording material and that a part of the heat of the heater 20 is conducted to the pressing roller 25 having a relatively large thermal capacity. For that reason, with repetition of the printing operation, the temperature of the pressing roller 25 gradually increases. This phenomenon continues until heat balance between an amount of flow of the heat from the heater 20 to the pressing roller 25 and an amount of dissipation of heat from the pressing roller 25 is achieved. For that reason, in a state in which the temperature of the pressing roller 25 is relatively low, it can be said that the heat (quantity) generated in the heater 20 easily flows (conducts) into the pressing roller 25. In this embodiment, as an index of ease of the flowing-in of the heat, the temperature of the pressing roller 25 is noted and is defined as the degree of heating of the pressing roller 25.

Next, a fixing counter prediction method for predicting the degree of heating of the pressing roller 25 will be described. In the fixing counter prediction method in this embodiment, every predetermined time during the printing operation, a predetermined coefficient (count value) depending on an operation state is added, and depending on an integrated count value of the fixing counter, a current temperature of the pressing roller 25 is predicted. Specifically, the state of the printing operation is divided into a plurality of stages (states), and a coefficient (count value) is determined every divided time (operation state or operation stage). The divided time is a time of pre-heating (from start of electric power supply to the heater 20 to turning-on of the top sensor 8 by detection of the leading end of the recording material P) or a time of sheet passing (from the turning-on of the top sensor 8 to turning-off of the top sensor 8 by passing of the trailing end of the recording material P through the top sensor 8). Further, the divided time is, for example, a time of a sheet interval (from the turning-off of the top sensor 8 to turning-on of the top sensor 8 by detection of a subsequent recording material P) or a time of a rest of the main assembly (when the printing operation is not performed). The predetermined coefficient (count value) is a value proportional to an amount of heat added to the pressing roller 25 per unit time and is a value calculated on the basis of a difference in a supplied electric power amount to the heater 20, heat dissipation amount from the heater 20 and the like.

Figure 10:
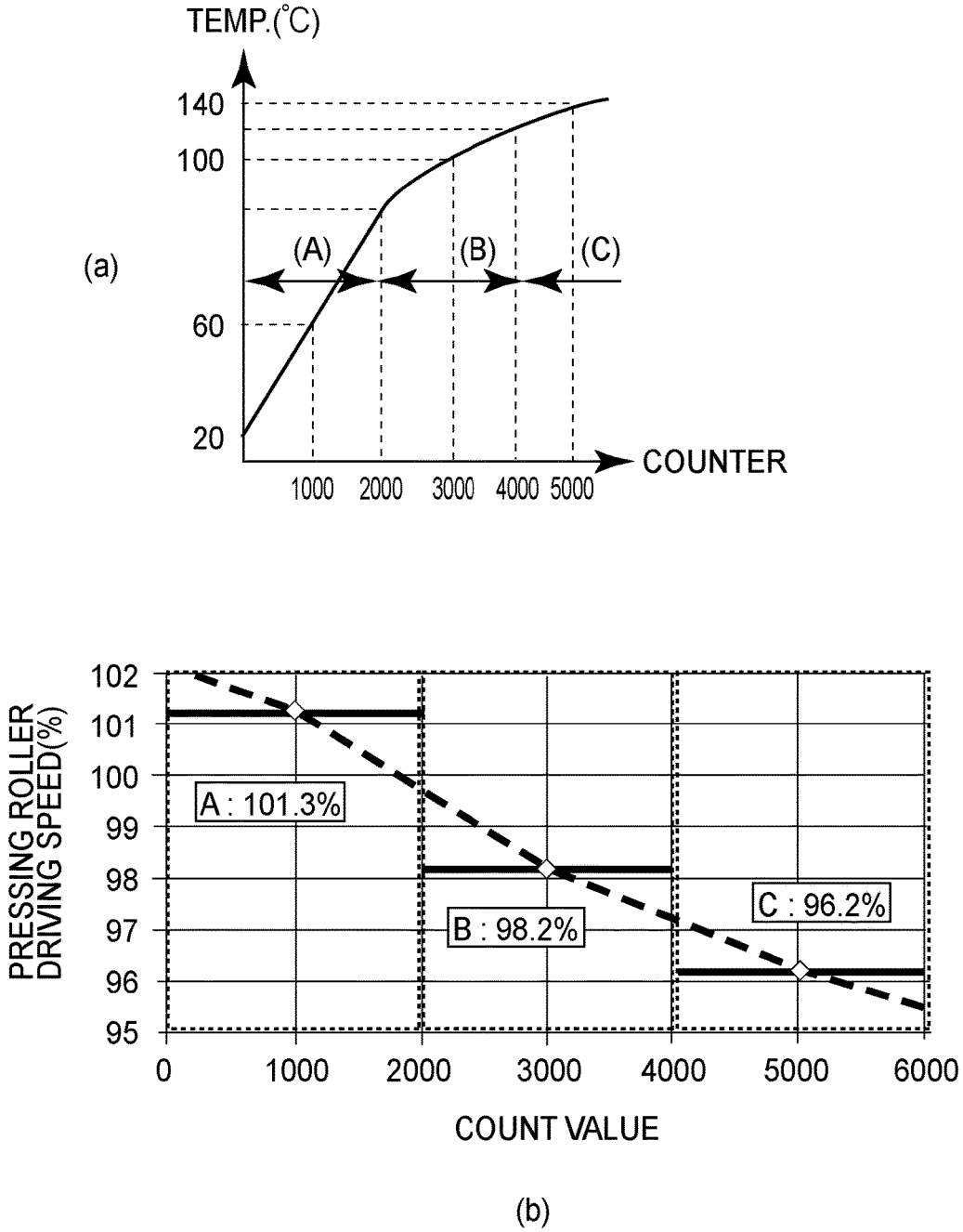
In FIG. 10,(*a*) is a graph showing a relationship between a count value of a fixing counter and a pressing roller temperature, and (*b*) is a graph showing a relationship between the count value of the fixing counter and a driving speed for providing a certain feeding speed of the pressing roller.

In FIG. 10,(*a*) shows a relationship between a count value of the fixing counter (abscissa) and a temperature (° C.) of the pressing roller 25 (ordinate) in the fixing counter prediction method. As shown in (a) of FIG. 10, regions (A), (B) and (C) are provided for associated count value ranges of the fixing counter, respectively, in which the count value range of 0-2000 is the region (A), the count value range of 2001-4000 is the region (B), and the count value range of not less than 4001 is the region (C). In the respective regions, examples of an addition coefficient of the fixing counter depending on the operation state of the image forming apparatus are shown in Table 3 below. In Table 3, an operation state column showing an apparatus state of the image forming apparatus includes the above-described states of the pre-heating, during the sheet passing, the sheet interval and the rest of the main assembly. As regards the fixing counter, coefficient values to be added are indicated depending on the operation state of the image forming apparatus.

TABLE 3

| OPERATION | FIXING COUNTER | | |
|---|---|---|---|
| STATE*[1] | 0-2000 | 2001-4000 | 4001- |
| PHS | +7 | +5 | +3 |
| DSP | +5 | +3 | +1 |
| DSI | +3 | +2 | +1 |
| ROMA | −5 | −9 | −18 |

*[1]"PHS" is the pre-heating state, "DSP" is during the sheet passing, "DSI" is during the sheet interval, and "ROMA" is the rest of the main assembly (the rest of the image forming operation).

The controller 31 adds an associated coefficient in Table 3 to the count value of the fixing counter every time when 200 msec has elapsed in an associated operation state, and then predicts the current temperature of the pressing roller 25 depending on an integrated count value. For example, in the case where the count value of the fixing counter is 1000 in the pre-heating state, 7 is added to the fixing counter, and in the case where the count value of the fixing counter is 3000 during the sheet passing, 3 is added to the fixing counter. Further, in the case where the count value of the fixing counter is 4500 in the rest of the main assembly, 18 is subtracted from the count value of the fixing counter. When a power source of the main assembly of the image forming apparatus is turned off, the count value of the fixing counter is reset. When the power source is turned on, an initial value of the fixing counter is determined on the basis of temperature information by a thermistor 24 which is a temperature detecting member for detecting the temperature of the heater 20 when the power source is turned on. Thereafter, every lapse of a predetermined time, to the initial value set to the fixing counter, the coefficient corresponding to the operation state shown in Table 3 is added in real time.

In the case where a constitution employing an environment sensor for measuring a temperature and a humidity of a placement environment is used, the added coefficient may also be corrected on the basis of the temperature and/or the humidity. In that case, accuracy of current temperature prediction of the pressing roller 25 is improved in view of a difference, in temperature of the recording material P, heat dissipation amount of the pressing roller 25, supplied electric power amount which vary depending on the environment, as a factor having the influence on the temperature of the pressing roller 25. The method for predicting the degree of heating of the pressing roller 25 is not limited to the above-described method, but may also be, e.g., a method for discriminating the degree of heating from a print number.

[Feeding Speed of Recording Material by Image Forming Apparatus]

In this embodiment, in order to stabilize the feeding state of the recording material P from the transfer nip to the fixing device C in the feeding path, the change in feeding speed due to outer diameter expansion of the pressing roller 25 generated by the heat of the heater 20 is calculated and predicted. Then, depending on the predicted change in feeding speed, the driving speed of the driving source 41 is changed, so that the feeding speed of the recording material P is maintained at a certain value to the possible extent. Such speed control is effected. In FIG. 10,(*b*) is a graph showing a relationship, between the count value of the fixing counter and the driving speed of the driving source 41, necessary to maintain the feeding speed of the recording material P by the pressing roller 25 at a certain value, in which the abscissa represents the count value of the fixing counter and the ordinate represents a ratio (%) of the driving speed of the pressing roller 25 to the process speed. In (b) of FIG. 10, driving speeds of the pressing roller 25 necessary to be made constant in the regions (A), (B) and (C) defined in (a) of FIG. 10, irrespective of thermal expansion. In the region (A), the temperature of the pressing roller 25 is relatively low, and therefore the outer diameter of the pressing roller 25 is small and there is a need to drive the pressing roller 25 at a somewhat high driving speed. Next, in the region (B), the pressing roller 25 is warmed and is in a warm state, so that the pressing roller 25 somewhat expands and the outer diameter of the pressing roller 25 is larger than that in the region (A). In the region (C), the pressing roller 25 is in a hot state and expands and has a further increased outer diameter, and therefore the driving speed of the driving source 41 is largely decreased. By these changes in driving speed of the pressing roller 25, the driving speed of the pressing roller 25 is not changed largely in each region, so that the feeding state of the recording material P is stabilized. As shown in (b) of FIG. 10, in order to maintain the driving speed of the pressing roller 25 at a certain value even when the count value of the fixing counter increases, the driving speed of the pressing roller 25 is made slow. In this embodiment, the region of the fixing counter is divided into the three regions (A), (B) and (C), and the driving speed at a center value of the count value range in each region is set at the driving speed of the pressing roller 25 in each region. In this embodiment, the region of the fixing counter is divided into the three regions, but may also be further divided. As the accuracy of the fixing counter is higher and the count value range in each of the divided regions is narrower, the feeding speed of the pressing roller 25 can be maintained at a certain value, so that it is possible to stabilize the feeding state of the recording material P in the feeding path from the transfer nip to the fixing device C.

[Feeding Speed of Discharging Device]

The feeding speed of the feeding rollers (e.g., the feeding roller 181 and the like) of the discharging device 18 is, similarly as in Embodiment 1, determined by the controller 32 on the basis of the process speed of the pressing roller 25 in each of the regions (A), (B) and (C), fed from the controller 31. Table 4 is a table showing a relationship among the fixing counter region, the driving speed of the pressing roller and the feeding speed of the discharging device.

TABLE 4

| FIXING COUNTER | REGION | DSOPR*1 | FSODD*2 |
|---|---|---|---|
| 0-2000 | A | 101.3% | 104.3% |
| 2001-4000 | B | 98.2% | 101.2% |
| 4001- | C | 96.2% | 99.2% |

*1"DSOPR" is a driving speed of the pressing roller.
*2"FSODD" is a predicted value of a feeding speed of the discharging device.

The four columns of Table 4 are constituted by the fixing counter, the region, a predicted value of the driving speed of the pressing roller, and the feeding speed of the discharging device from a leftmost column. In the column of the fixing counter, count value ranges of the fixing counter corresponding to the regions (A), (B) and (C), respectively are shown. In the column of the predicted value of the driving speed of the pressing roller 25, predicted values of the driving speeds of the pressing roller 25 corresponding to the regions (A), (B) and (C), respectively are shown, i.e., 101.3%, 98.3% and 96.2% which are the center values in the respective regions shown in (a) of FIG. 10 are shown. In the column of the feeding speed of the discharging device, feeding speeds of the feeding roller 181 or the like set on the basis of the predicted values of the driving speeds of the pressing roller 25 are shown. The feeding speed of each of the feeding rollers of the discharging device 18 is, similarly as in Embodiment 1, determined by the peripheral speed difference between the feeding speeds of the discharging roller 14 and the pressing roller 25, and in this embodiment, is (driving speed of pressing roller 25)+3%. The driving speed of the feeding roller of the discharging device is a speed proportional to the driving speed of the driving source 42.

[Flowchart of Feeding Control]

Figure 11:
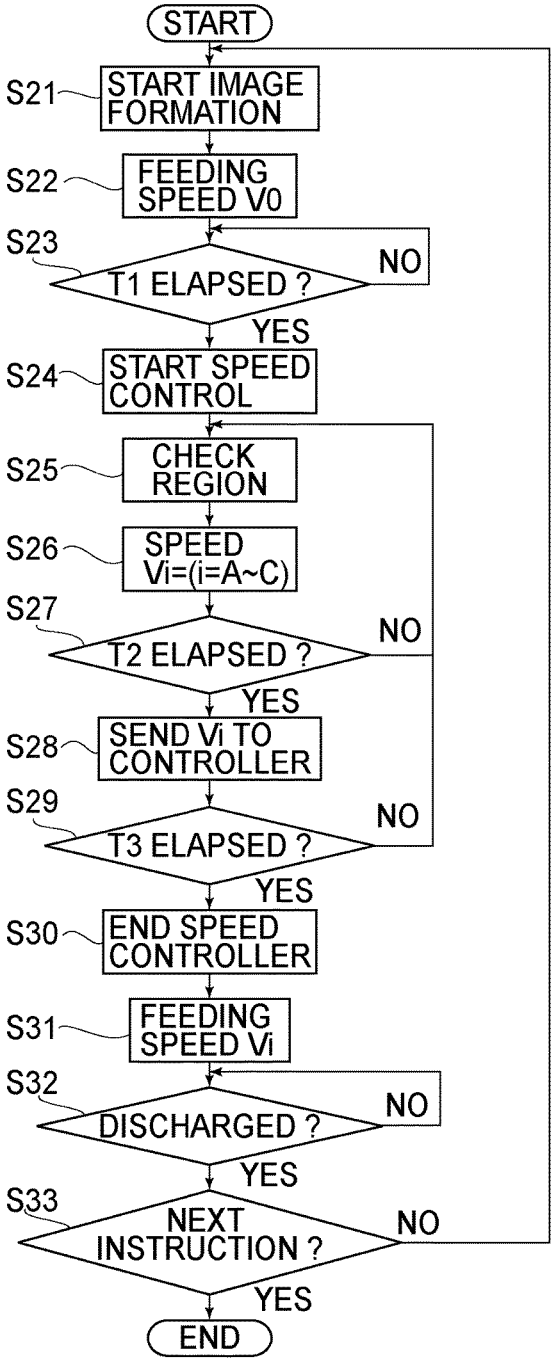
In FIGS. 11,(*a*) and (*b*) are flowcharts of feeding control in Embodiment 2.
Figure 11:
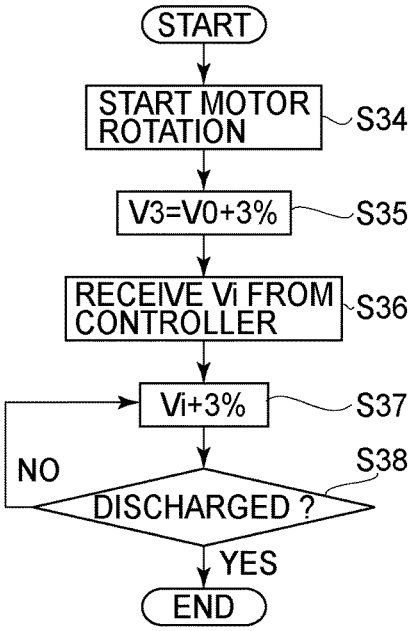

A flowchart of the feeding control of the recording material P in this embodiment is shown in FIG. 11. Control based on the flowchart shown in (a) of FIG. 11 is executed by the controller 31 of the image forming apparatus on the basis of a program stored in the ROM or the like. Control based on the flowchart shown in (b) of FIG. 11 is executed by the controller 32 of the discharging device 18 on the basis of a program stored in the ROM or the like.

First, the flowchart of (a) of FIG. 11 will be described. The controller 31 feeds the recording material P from the cassette 7 and starts the image forming operation (S21). Then, the controller 31 controls the driving speed of the driving source 41 and thus sets the feeding speed of the recording material P by the pressing roller 25 at V0 (S22). V0 is the feeding speed which is 100% of the process speed.

The controller 31 discriminates whether or not a first predetermined time T1 has elapsed from start of the image formation (S23). The first predetermined time T1 is set correspondingly the process speed corresponding to the feeding speed of the recording material P and is a time required until the leading end of the recording material P enters the fixing nip. When the controller 31 discriminated that the first predetermined time T1 elapsed, the controller 31 starts the above-described speed renewal control (S24). That is, in the case where the controller 31 checks that a warm-air counter belongs to any one of the regions (A), (B) and (C) (S25) at that time, and sets the feeding speed of the recording material P by the pressing roller 25 at a feeding speed Vi in an associated region (S26).

The controller 31 discriminates whether or not a second predetermined time T2 has elapsed from the start of the image formation (S27). The second predetermined time T2 is set correspondingly to the process speed for the recording material P and is a time required until the leading end of the recording material P enters the mostupstream feeding roller of the discharging device 18. When the controller 31 discriminated that the second predetermined time T2 elapsed, the controller 31 sends information on the feeding speed Vi of the recording material P at that time to the controller 32 of the discharging device 18 (S28).

The controller 31 discriminates whether or not a third predetermined time T3 has elapsed from the starts of the image formation (S29). The third predetermined time T3 is a time required until the trailing end of the recording material P passes through the transfer roller 6. When the controller 31 discriminated that the third predetermined time T3 elapsed, the controller 31 ends the speed renewal control (S30). Then, the controller 31 controls the driving speed of the driving source 41, and maintains the feeding speed of the recording material P by the pressing roller 25 at the feeding speed Vi (S31). The controller 31 discriminates whether or not the recording material P is discharged from the image forming apparatus (S32), and when the controller 31 discriminated that the recording material P was discharged, the controller 31 checks whether or not a subsequent image forming instruction is provided (S33). In the case where the subsequent image forming instruction is provided, the process of the controller 31 returns to S1. In the case where the subsequent image forming instruction is not provided, the control in this flowchart is ended.

The flowchart of (b) of FIG. 11 will be described. The controller 32 starts rotation of the driving source 42 (S34), and sets the feeding speed of the recording material P by the feeding roller 181 at V3 (S35). V3 is the above-described feeding speed V3=V0+3%. When the controller 32 receives information on the feeding speed Vi from the controller 31 of the image forming apparatus (S36), the controller 32 controls the driving speed of the driving source 42, and sets the feeding speed of the recording material P by the feeding roller 181 at Vi+3% (S37). The controller 32 discriminates whether or not the recording material P is discharged from the discharging device 18 (S38), and when the controller 32 discriminated that the recording material P was discharged from the discharging device 18, the controller 32 ends the control of this flowchart.

Then, evaluation results as to a generation frequency of the image defect due to the slide of the recording material and a generation frequency of the paper jam in the constitution in this embodiment shown at the portion (B) of FIG. 1 are shown in Tables 5 and 6. Table 5 shows the evaluation result as to the generation frequency of the image defect due to the slide of the recording material every paper species of the recording material P, in which a left-hand table shows the evaluation result in the case where plain paper or thin paper is used, and a right-hand table shows the evaluation result in the case where thick paper is used. Similarly, Table 6 shows the evaluation result as to the generation frequency of the paper jam every paper species of the recording material P, in which a left-hand table shows the evaluation result in the case where the plain paper or the thin paper is used, and a right-hand table shows the evaluation result in the case where the thick paper is used.

The constitutions in the respective tables are the same. In a leftmost column, a ratio (%) of the feeding speed to the process speed ("FIXING DISCHARGE RATIO" in the table) and is 99.2%, 101.3% and 104.3% with an increment of 2%. On the other hand, other three columns are those corresponding to the feeding speeds of the feeding roller 183 or the like of the discharging device 18. The second column from the leftmost column shows the evaluation result in the case where the feeding speed control of the feeding roller in this embodiment was effected. The right-hand two columns show the evaluation result in the case where the feeding speed of the feeding roller of the discharging device 18 was the fixed speed ("FIXED SPEED" in the table) described with reference to (d) of FIG. 7 in the conventional examples. The fixed speed in the case of the conventional examples was 100% and 104% relative to the process speed. The evaluation was made as follows. In Table 5, "o" represents no generation of the image defect, "Δ" represents that the toner on the recording material P was peeled off by being slid with the guiding wall of the feeding path of the discharging device 18 and slight image defect generated, and "x" represents that serious image defect practically generated. On the other hand, in Table 6, the evaluation result of the number of times of generations of the paper jam resulting from the passing of 1000 sheets of the recording material P through the discharging device 18, in which "o" represents that the number of paper jam generation times is 0, "Δ" represents that the number of paper jam generation times is less than 5, and "x" represents that the number of paper jam generation times is not less than 5.

TABLE 5

| <PP/TNP*1> DDS*2 | | | |
|---|---|---|---|
| | | CE(FS) *4 | |
| FDR*3 | EMB. 2 | 100% | 104% |
| 99.2% | ○ | ○ | x |
| 101.3% | ○ | ○ | Δ |
| 104.3% | ○ | Δ | ○ |

| <TKP*1> DDS*2 | | | |
|---|---|---|---|
| | | CE(FS) *4 | |
| FDR*3 | EMB. 2 | 100% | 104% |
| 99.2% | ○ | ○ | Δ |
| 101.3% | ○ | ○ | Δ |
| 104.3% | ○ | Δ | ○ |

*1"PP/TNP" is plain paper or thin paper.
*2"DDS" is a discharging device speed.
*3"FDR" is a feeding discharge ratio.
*4"CE(FS)" is a conventional example (fixed speed).
*5"TKP" is thick paper.

TABLE 6

| <PP/TNP*1> DDS*2 | | | |
|---|---|---|---|
| | | CE(FS) *4 | |
| FDR*3 | EMB. 2 | 100% | 104% |
| 99.2% | ○ | ○ | Δ |
| 101.3% | ○ | ○ | ○ |
| 104.3% | ○ | Δ | ○ |

TABLE 6-continued

| <TKP*1> DDS*2 | | | |
|---|---|---|---|
| | | CE(FS) *4 | |
| FDR*3 | EMB. 2 | 100% | 104% |
| 99.2% | ○ | ○ | Δ |
| 101.3% | ○ | ○ | ○ |
| 104.3% | ○ | ○ | ○ |

*1"FF/TNP" is plain paper or thin paper.
*2"DDS" is a discharging device speed.
*3"FDR" is a feeding discharge ratio.
*4"CE(FS)" is a conventional example (fixed speed).
*5"TKP" is thick paper.

From Table 5, it is understood that the image defect generates due to the slide of the recording material P with the guiding wall in the case where the feeding speed of the feeding roller of the discharging device in the conventional example is a fixed speed, but does not generate by effecting the above-described feeding speed control of the rollers in the case of Embodiment 1. Further, also from Table 6, it is understood that the paper jam generates in the case where the feeding speed of the feeding roller of the discharging device in the conventional example is the fixed speed, but does not generate by effecting the above-described feeding speed control of the rollers in the case of Embodiment 1. That is, from Tables 5 and 6, it is understood that the recording material P is prevented from contacting the guiding wall of the recording material feeding path by the feeding speed control of the rollers on the basis of the prediction of the temperature of the pressing roller 25 and thus degrees of the image defect due to the slide of the recording material P and the paper jam decreases.

As described above, according to this embodiment, it is possible to stabilize the feeding state of the recording material between the image forming apparatus and the discharging device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-202125 filed on Oct. 13, 2015, and 2016-158956 filed on Aug. 12, 2016, which are hereby incorporated by reference herein in their entirety.

What is claimed is:

1. An image forming system comprising:

an image forming apparatus configured to form an image on a recording material; and a discharging device configured to discharge the recording material on which the image has been formed, wherein the image forming apparatus includes (1) an image forming unit configured to form the image on the recording material, (2) a fixing unit configured to fix the image formed on the recording material by the image forming unit, (3) a discharging unit configured to discharge the recording material on which the image has been fixed by the fixing unit to the discharging device, (4) a first driving motor configured to drive the fixing unit and the discharging unit, (5) a first control unit configured to control the first driving motor, and (6) a loop detecting portion configured to detect a loop amount of the recording material between the image forming unit and the fixing unit, and wherein the discharging device includes (1) a conveying unit configured to convey the recording material discharged from the image forming apparatus, (2) a second driving motor configured to drive the conveying unit, and (3) a second control unit configured to control the second driving motor, wherein the first control unit (a) controls a driving speed of the first driving motor so that the loop amount falls within a predetermined range, and (b) sends information concerning the driving speed of the first driving motor to the second control unit, and wherein the second control unit controls a driving speed of the second driving motor depending on the information concerning the driving speed of the first driving motor sent from the first control unit.

2. The image forming system according to claim 1, wherein the image forming unit includes a transfer roller configured to transfer an image formed on an image bearing member onto the recording material, wherein the fixing unit includes a heater portion, a film to be heated by the heater portion, and a pressing roller configured to form a nip in contact with the film, wherein the discharging unit includes a discharging roller, and wherein the conveying unit includes a conveying roller.

3. The image forming system according to claim 2, wherein an outer diameter of the pressing roller fluctuates by heat conducted from the heater portion through the film.

4. The image forming system according to claim 2, wherein feeding speeds of the pressing roller and the discharging roller which are driven by the first driving motor are in a proportional relationship.

5. The image forming system according to claim 2, wherein when a nip pressure at the pressing roller is F1, a nip pressure at the discharging roller is F2, and a nip pressure at the conveying roller is F3, these nip pressures satisfy the following relationship:

$$F1>F3>F2.$$

6. The image forming system according to claim 1, wherein on the basis of a detection result of the loop detecting portion, the first control unit switches the driving speed of the first driving motor to a first speed or a second speed slower than the first speed to drive the fixing unit thereby to effect control so that the loop amount of the recording material falls within the predetermined range.

7. The image forming system according to claim 6, wherein the first control unit switches the driving speed of the first driving motor in a first section from a timing when a leading end of the recording material reaches the fixing unit to a timing when a trailing end of the recording material passes through the image forming unit, and after the timing when the trailing end of the recording material passes through the image forming unit, the first control unit sets the driving speed of the first driving motor to an average speed of the first driving motor in the first section.

8. The image forming system according to claim 6, wherein the first control unit sends an average speed of the first driving motor in a second section to the second control unit, the second section being from a timing when the leading end of the recording material enters the fixing unit to a timing when the leading end of the recording material enters the conveying unit of the discharging device.

9. The image forming system according to claim 8, wherein the second control unit controls the second driving motor so that the conveying unit is driven at a speed obtained by adding a predetermined proportion to the average speed sent from the first control unit.

10. An image forming system comprising:

an image forming apparatus configured to form an image on a recording material; and a discharging device configured to discharge the recording material on which the image has been formed, wherein the image forming apparatus includes (1) an image forming unit configured to form the image on the recording material, (2) a fixing unit configured to fix the image formed on the recording material by the image forming unit, (3) a discharging unit configured to discharge the recording material on which the image has been fixed by the fixing unit to the discharging device, (4) a first driving motor configured to drive the fixing unit and the discharging unit, and (5) a first control unit configured to control the first driving motor, wherein the discharging device includes (1) a conveying unit configured to convey the recording material discharged from the image forming apparatus, (2) a second driving motor configured to drive the conveying unit, and (3) a second control unit configured to control the second driving motor, wherein the first control unit (a) switches a driving speed of the first driving motor depending on information concerning a temperature of the fixing unit to drive the fixing unit thereby to effect control so that a loop amount of the recording material between the image forming unit and the fixing unit falls within a predetermined range, and (b) sends information concerning the driving speed of the first driving motor to the second control unit, and wherein the second control unit controls a driving speed of the second driving motor depending on the information concerning the driving speed of the first driving motor sent from the first control unit.

11. The image forming system according to claim 10, wherein the first control unit includes a counter configured to estimate the temperature of the fixing unit on the basis of a count value of the counter, and wherein the counter estimates the temperature of the fixing unit on the basis of a count value obtained by integrating the count value of the counter with a predetermined count value depending on a current operation state of the image forming apparatus every predetermined time, and estimates the temperature of the fixing unit on the basis of the integrated count value.

12. The image forming system according to claim 11, wherein the predetermined count value is a positive count value when the image forming apparatus performs an image forming operation, and is a negative count value when the image forming apparatus stops the image forming operation.

13. The image forming system according to claim 10, wherein the first control unit sends a feeding speed of the fixing unit at a predetermined timing to the second control unit, the predetermined timing being a timing when the leading end of the recording material enters the conveying unit of the discharging device.

14. The image forming system according to claim 1, wherein the loop detecting portion includes (a) a sensor portion including a light emitting portion and a light receiving portion configured to receive light from the light emitting portion, and (b) a flag configured to permit transmission or blocking of the light by rotating depending on a loop state of the recording material contacting the flag, and wherein the loop detecting portion detects the loop amount of the recording material on the basis of a detection result of the light emitted from the light emitting portion to the light receiving portion.

15. An image forming system comprising:

an image forming unit configured to form an image on a recording material;

a fixing unit configured to fix the image formed on the recording material by the image forming unit;

a first conveying unit configured to convey the recording material on which the image has been fixed by the fixing unit;

a first driving motor configured to drive the fixing unit and the first conveying unit;

a loop detecting portion configured to detect a loop amount of the recording material between the image forming unit and the fixing unit;

a second conveying unit configured to convey the recording material conveyed from the first conveying unit;

a second driving motor configured to drive the second conveying unit; and a control unit configured to control the first driving motor and the second driving motor, wherein the control unit controls a driving speed of the first driving motor so that the loop amount falls within a predetermined range, and wherein the control unit controls a driving speed of the second driving motor depending on information concerning the driving speed of the first driving motor.

16. The image forming system according to claim 15, wherein the control unit controls the driving speed of the second driving motor depending on an average speed of the first driving motor in a section from a timing when the leading end of the recording material reaches the fixing unit to a timing when the leading end of the recording material reaches the second conveying unit.

17. The image forming system according to claim 15, wherein the loop detecting portion includes (a) a sensor portion including a light emitting portion and a light receiving portion configured to receive light from the light emitting portion, and (b) a flag configured to permit transmission or blocking of the light by rotating depending on a loop state of the recording material contacting the flag, and wherein the loop detecting portion detects the loop amount of the recording material on the basis of a detection result of the light emitted from the light emitting portion to the light receiving portion.

18. The image forming system according to claim 15, wherein on the basis of the detection result of the loop detecting portion, the first control unit switches the driving speed of the first driving motor to a first speed or a second speed slower than the first speed to drive the fixing unit thereby to effect control so that the loop amount of the recording material falls within the predetermined range.

19. The image forming system according to claim 15, wherein the image forming unit includes a transfer roller configured to transfer an image formed on an image bearing member onto the recording material, wherein the fixing unit includes a heater portion, a film to be heated by the heater portion, and a pressing roller for configured to form a nip in contact with the film, wherein the first conveying unit includes a first conveying roller, and wherein the second conveying unit includes a second conveying roller.

20. The image forming system according to claim 13, wherein the second control unit controls the second driving motor so that the conveying unit is driven at a speed obtained by adding a predetermined proportion to a feeding speed of the fixing unit sent from the first control unit.

* * * * *